US006848771B2

(12) United States Patent
Cabal

(10) Patent No.: US 6,848,771 B2
(45) Date of Patent: Feb. 1, 2005

(54) METHOD OF OPERATING A THERMAL ACTUATOR AND LIQUID DROP EMITTER WITH MULTIPLE PULSES

(75) Inventor: Antonio Cabal, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 28 days.

(21) Appl. No.: 10/610,169

(22) Filed: Jun. 30, 2003

(65) Prior Publication Data

US 2004/0263546 A1 Dec. 30, 2004

(51) Int. Cl.[7] ..... B41J 2/05
(52) U.S. Cl. ..... 347/57
(58) Field of Search ..... 347/57, 54, 56, 347/55, 61, 68, 75, 69, 65, 70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 3,747,120 | A | 7/1973 | Stemme |
| 3,946,398 | A | 3/1976 | Kyser et al. |
| 4,296,421 | A | 10/1981 | Hara et al. |
| 5,599,695 | A | 2/1997 | Pease et al. |
| 5,771,882 | A | 6/1998 | Psaros et al. |
| 5,902,648 | A | 5/1999 | Naka et al. |
| 6,067,797 | A | 5/2000 | Silverbrook |
| 6,087,638 | A | 7/2000 | Silverbrook |
| 6,180,427 | B1 | 1/2001 | Silverbrook |
| 6,239,821 | B1 | 5/2001 | Silverbrook |
| 6,243,113 | B1 | 6/2001 | Silverbrook |
| 6,254,793 | B1 | 7/2001 | Silverbrook |
| 6,274,056 | B1 | 8/2001 | Silverbrook |
| 6,435,666 | B1 * | 8/2002 | Trauernicht et al. ..... 347/54 |

FOREIGN PATENT DOCUMENTS

| | | |
|---|---|---|
| JP | 20330543 | 1/1990 |

* cited by examiner

*Primary Examiner*—Raquel Yvette Gordon
(74) *Attorney, Agent, or Firm*—Antonio Cabal

(57) ABSTRACT

Methods of operating a thermal actuator, especially for use in a liquid drop emitter for ink jet printing, are disclosed. Methods are disclosed for operating a thermal actuator comprising a base element, a thermo-mechanical element extending from the base element, having a moveable portion residing in a first position and reliably operating at temperatures below a maximum temperature $T_{max}$ and including apparatus adapted to apply energy pulses to the thermo-mechanical element to cause a temperature increase therein and movement of the moveable portion to a second position. The methods for operating comprise determining a first energy pulse having a first energy, $E_1$, and a first energy pulse time, $t_1$, for suddenly increasing the temperature of the thermo-mechanical actuator, but not above $T_{max}$. Further, determining a second energy pulse having a second energy, $E_2$, and a second energy pulse time, $t_2$, that when applied after the first energy pulse, causes the moveable portion to move to or remain at the second position. Also, determining a first delay time, $t_{di}$, selected, at least, to avoid increasing the temperature of the thermo-mechanical element above $T_{max}$. The first energy pulse is applied to the thermo-mechanical element; then, after waiting a first delay time $t_{di}$, applying the second energy pulse to the thermo-mechanical element so that the moveable portion moves to or remains at the second position and the maximum temperature is not exceeded. When used to operate liquid drop emitters, the disclosed methods cause liquid drop emission without exceeding the maximum temperature of reliable operation of the thermo-mechanical element.

50 Claims, 20 Drawing Sheets

| W(μm) | L(μm) | D(μm) | F(KHz) | $\tau_R$(μsec) | $\tau_D$(μsec) | $\tau_D/\tau_R$ |
|---|---|---|---|---|---|---|
| 15 | 115 | 45 | 36.6 | 27.32 | 14.40 | 0.53 |
| 20 | 115 | 45 | 42.7 | 23.42 | 15.80 | 0.67 |
| 30 | 115 | 45 | 50.3 | 19.88 | 17.80 | 0.90 |
| 15 | 115 | 35 | 51.4 | 19.46 | 13.40 | 0.69 |
| 25 | 115 | 40 | 53 | 18.87 | 16.00 | 0.85 |
| 15 | 115 | 30 | 60 | 16.67 | 11.70 | 0.70 |
| 30 | 95 | 45 | 65.6 | 15.24 | 11.00 | 0.72 |
| 25 | 95 | 40 | 71.6 | 13.97 | 10.00 | 0.72 |
| 30 | 95 | 40 | 74 | 13.51 | 10.40 | 0.77 |

METHOD OF OPERATING A THERMAL ACTUATOR AND LIQUID DROP EMITTER WITH MULTIPLE PULSES

FIELD OF THE INVENTION

The present invention relates generally to micro-electromechanical devices and, more particularly, to micro-electromechanical thermal actuators such as the type used in ink jet devices and other liquid drop emitters, and methods of operating same.

BACKGROUND OF THE INVENTION

Micro-electro mechanical systems (MEMS) are a relatively recent development. Such MEMS are being used as alternatives to conventional electromechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combines the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2,030,543, field Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, K. Silverbrook in U.S. Pat. Nos. 6,067,797; 6,087,638; 6,239,821 and 6,243,113 has made disclosures of a similar thermo-mechanical ink jet configuration. Methods of manufacturing thermo-mechanical ink jet devices using microelectronic processes have been disclosed by K. Silverbrook in U.S. Pat. Nos. 6,180,427; 6,254,793 and 6,274,056.

Thermo-mechanically actuated drop emitters employing various bending element designs are promising as low cost devices which can be mass produced using microelectronic materials and equipment and which allow operation with liquids that would be unreliable in a thermal ink jet device. However, the design and operation of bending thermal actuators and drop emitters requires careful attention to preventing locations of potentially excessive heat, especially within the bending element which may be adjacent to the working liquid.

The immediately adjacent working liquid, for example ink for ink jet printing, may be overheated to the point of causing boiling, component degradation, or air dissolution, if too much energy is applied or applied too rapidly. The production of vapor bubbles in the working liquid immediately adjacent a resistive heater is purposefully employed in thermal ink jet devices to provide pressure pulses sufficient to eject ink drops. However, such vapor bubble formation is undesirable in a thermo-mechanically actuated drop emitter because it causes anomalous, erratic changes in drop emission timing, volume, and velocity. Also bubble formation may be accompanied by fee aggressive bubble collapse damage and a build-up of degraded components of the working liquid on the cantilevered element.

Configurations and methods of operation for bending element thermal actuators are needed which can be operated at high repetition frequencies and with maximum force of actuation, while avoiding locations of extreme temperature or generating vapor bubbles.

SUMMARY OF THE INVENTION

It is therefore an object of the present invention to provide a method of operation of a thermo-mechanical actuator that does not cause excessive, debilitating, temperatures, and that can be operated at high repetition frequencies and for millions of cycles of use without failure.

It is also an object of the present invention to provide a method of operation of a liquid drop emitter that is actuated by a thermo-mechanical actuator which does not reach temperatures that cause vapor bubble formation in the working liquid.

It is a further object of the present invention to provide apparatus for thermal actuators and liquid drop emitters that operate reliably.

The foregoing and numerous other features, objects and advantages of the present invention will become readily apparent upon a review of the detailed description, claims and drawings set forth herein. These features, objects and advantages are accomplished by operating a thermal actuator for a micro-electromechanical device comprising a base element and a thermo-mechanical element extending from the base element, having a moveable portion residing in a first position and reliably operating at temperatures below a maximum temperature $T_{max}$ and including apparatus adapted to apply energy pulses to the thermo-mechanical element to cause a temperature increase therein and movement of the moveable portion to a second position. The methods for operating comprise determining a first energy pulse having a first energy, $E_1$, and a first energy pulse time, $t_1$, for suddenly increasing the temperature of the thermo-mechanical actuator, but not above $T_{max}$. Further, determining a second energy pulse having a second energy, $E_2$, and a second energy pulse time, $t_2$, that when applied after the first energy pulse, causes the moveable portion to move to or remain at the second position. Also, determining a first delay time, $t_{di}$, selected, at least, to avoid increasing the temperature of the them mechanical element above $T_{max}$. The first energy pulse is applied to the thermo-mechanical element; then, after waiting a first delay time $t_{di}$, a second energy pulse is applied to the thermo-mechanical element so that the moveable portion moves to or remains at the second position and the maximum temperature is not exceeded. Additional methods are disclosed wherein more than two energy pulses are applied for an actuation.

The present invention is particularly useful as a method of operation for a thermal actuator for liquid drop emitters used as printheads for DOD ink jet printing. In this preferred embodiment the thermal actuator resides in a liquid-filled chamber that includes a nozzle for ejecting liquid. The thermal actuator includes a thermo-mechanical element extending from a wall of the chamber and a movable portion residing in a first position within the chamber. Application of energy pulses according to the present inventions causes emission of liquid drops liquid without exceeding a maximum temperature for reliable operation of the thermal actuator.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides a method of operation of apparatus for a thermal actuator and a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide drop emitters based on thermo-mechanical actuators that are configured and operated so as to avoid locations of excessive temperature which might otherwise cause erratic performance and early device failure.

Figure 1:
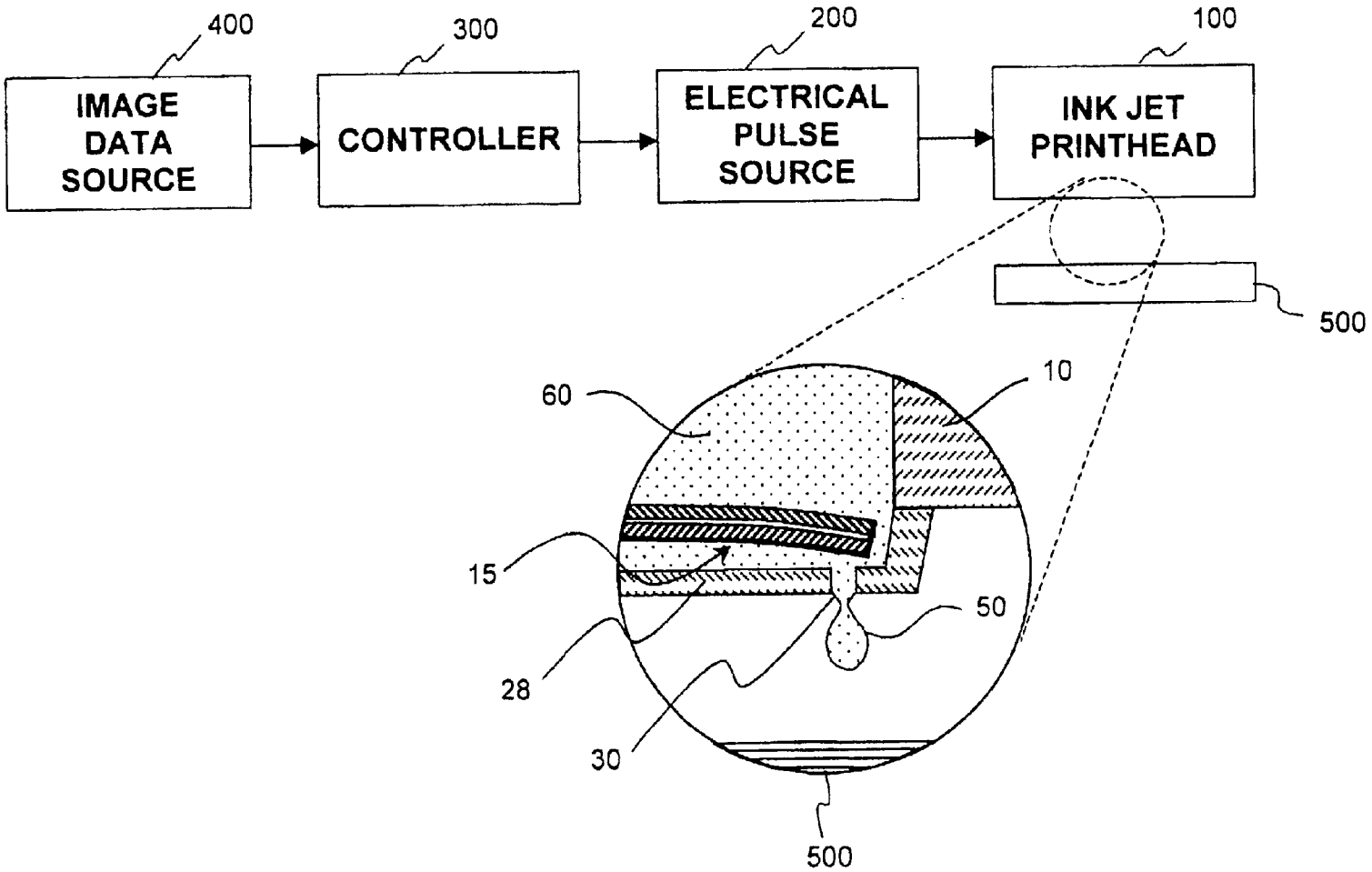
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 that provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermo-mechanical actuator 15 within ink jet printhead 100. The electrical energy pulses cause a thermo-mechanical actuator 15 (herein after "thermal actuator") to rapidly bend, pressurizing ink 60 located at nozzle 30, and emitting an ink drop 50 which lands on receiver 500.

Figure 2:
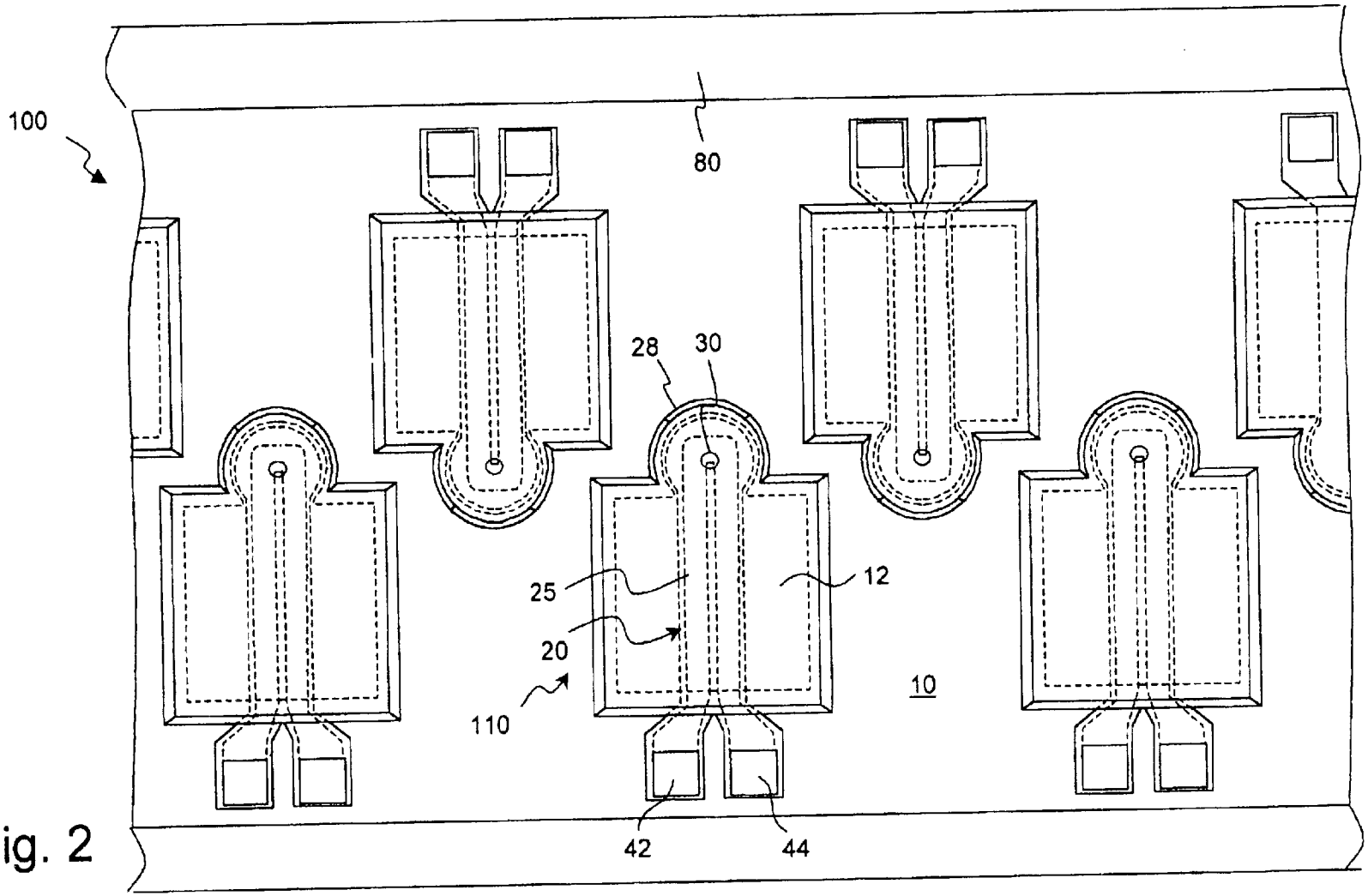
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in U.S. Pat. No. 6,561,627 for "Thermal Actuator", assigned to the assignee of the present invention.

Each drop emitter unit 110 has associated electrical lead contacts 42, 44 that are formed with, or are electrically connected to, a heater resistor portion 25, shown in phantom view in FIG. 2. In the illustrated embodiment, the heater resistor portion 25 is formed in a deflector layer of the thermal actuator 15 and participates in the thermo-mechanical effects as will be described. Element 80 of the printhead 100 is a mounting structure which provides a mounting surface for microelectronic substrate 10 and other means for interconnecting the liquid supply, electrical signals, and mechanical interface features.

Figure 3A:
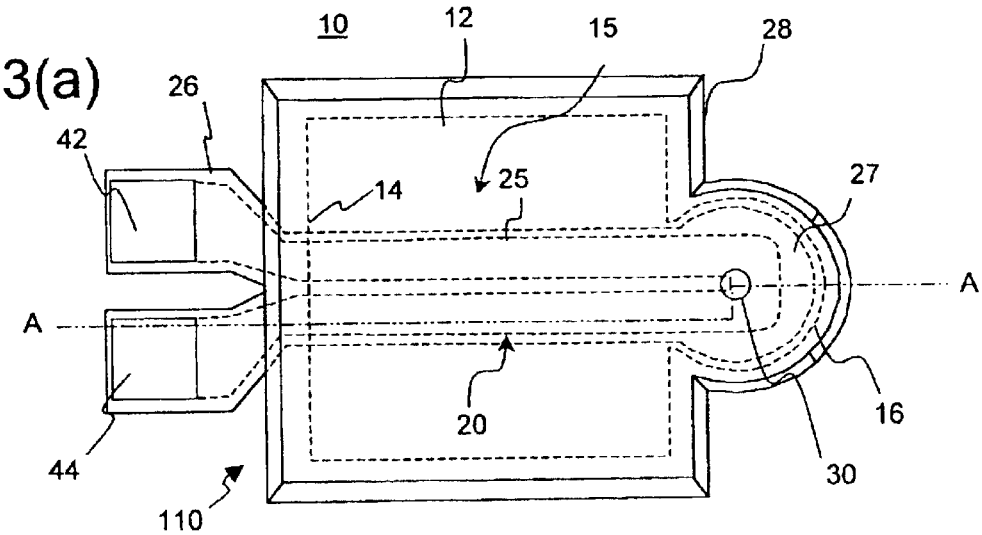
FIGS. 3(*a*) and 3(*b*) are an enlarged plan views of an individual ink jet unit shown in FIG. 2.
Figure 3B:
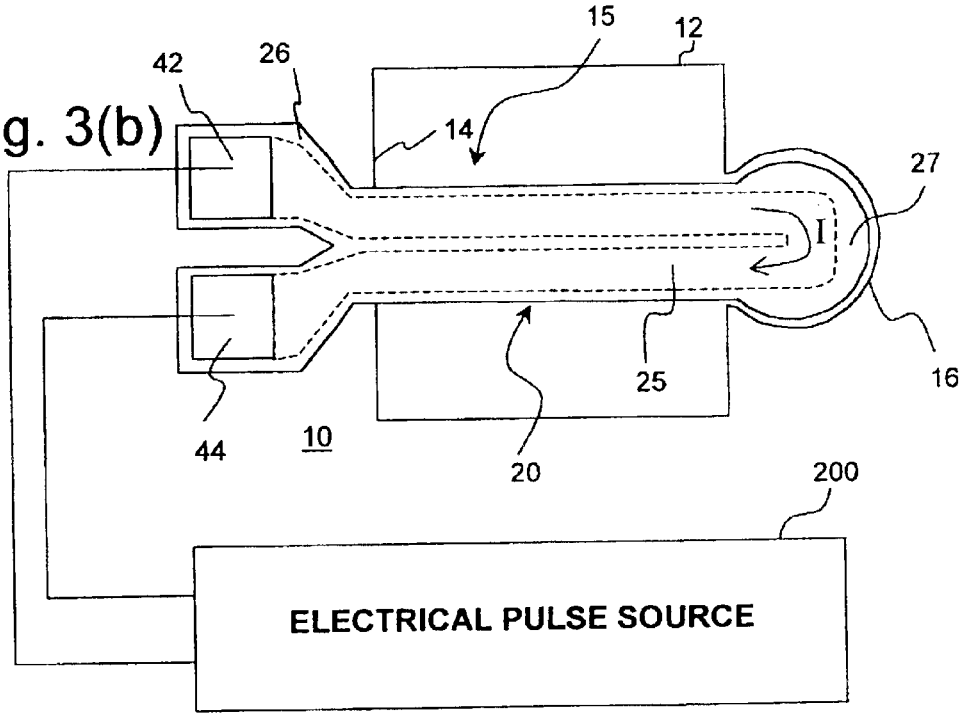

FIG. 3(*a*) illustrates a plan view of a single drop emitter unit 110 and a second plan view FIG. 3(*b*) with the liquid chamber cover 28, including nozzle 30, removed.

The thermal actuator 15, shown in phantom in FIG. 3(*a*) can be seen with solid lines in FIG. 3(*b*). The cantilevered element 20 of thermal actuator 15 extends from edge 14 of lower liquid chamber 12 which is formed in substrate 10. Cantilevered element anchor portion 26 is bonded to substrate 10 and anchors the cantilever.

The cantilevered element 20 of the actuator has the shape of a paddle, an extended flat shaft ending with a disc of larger diameter than the shaft width. This shape is merely illustrative of cantilever actuators that can be used, many other shapes are applicable. The paddle shape aligns the nozzle 30 with the center of the cantilevered element free end portion 27. The lower fluid chamber 12 has a curved wall portion at 16 which conforms to the curvature of the free end portion 27, spaced away to provide clearance for the actuator movement.

FIG. 3(*b*) illustrates schematically the attachment of electrical pulse source 200 to the resistive heater 25 at interconnect terminals 42 and 44. Voltage differences are applied to voltage terminals 42 and 44 to cause resistance heating via u-shaped resistor 25. This is generally indicated by an arrow showing a current I. In the plan views of FIG. 3, the actuator free end portion 27 moves toward the viewer when pulsed and drops are emitted toward the viewer from the nozzle 30 in cover 28. This geometry of actuation and drop emission is called a "roof shooter" in many ink jet disclosures.

Figure 4A:
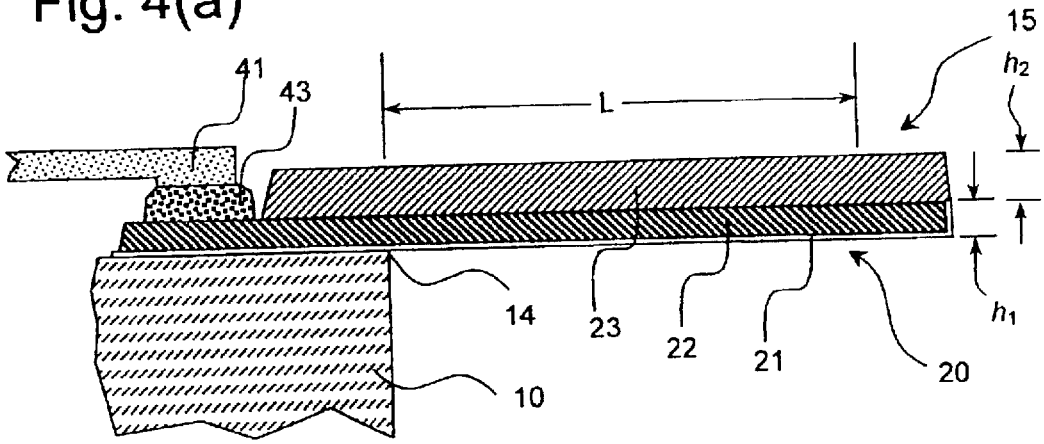
FIGS. 4(*a*) and 4(*b*) are a side views illustrating the movement of a thermal actuator according to the present invention.
Figure 4B:
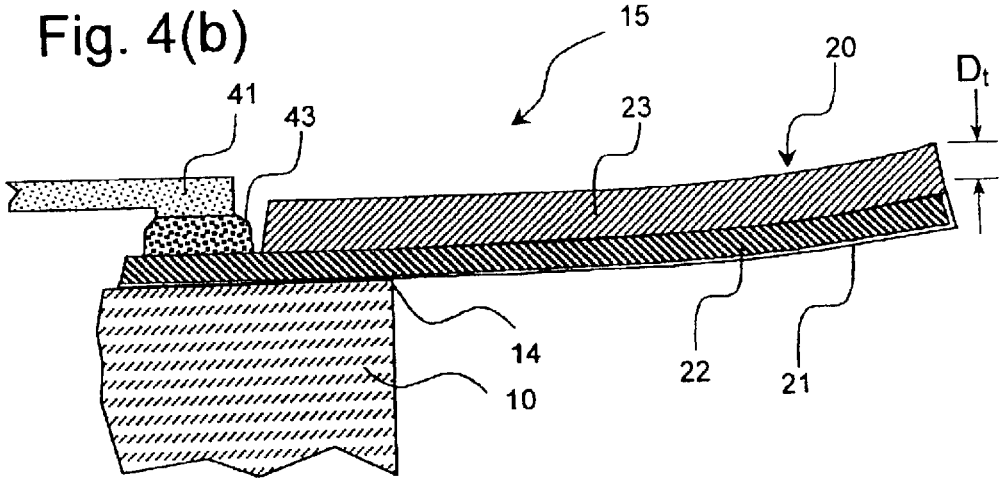

FIGS. 4(*a*) and 4(*b*) illustrate in side view a cantilevered thermal actuator 15 according to a preferred embodiment of the present invention. In FIG. 4(*a*) the actuator is in a first position and in FIG. 4(*b*) it is shown deflected upward to a second position. Cantilevered element 20 extends a length L from an anchor location 14 of base element 10 to the center of free end 27. The cantilevered element 20 is constructed of several layers. Deflector layer 22 causes the upward deflection when it is thermally elongated with respect to other layers in the cantilevered element 20. It is constructed of an electrically resistive material, preferably intermetallic titanium aluminide, that has a large coefficient of thermal expansion. Deflector layer 22 has a thickness of $h_1$.

The cantilevered element 20 also includes a top layer 23, attached to the deflector layer 22. The top layer 23 is constructed of a material having a low coefficient of thermal expansion, with respect to the material used to construct the deflector layer 22. The thickness of top layer 23 is chosen to provide the desired mechanical stiffness and to maximize the deflection of the cantilevered element for a given input of heat energy. Top layer 23 may also be a dielectric insulator to provide electrical insulation for resistive heater segments and current coupling devices and segments formed into the deflector layer or in a third material used in some preferred embodiments of the present inventions. The top layer may be used to partially define resistor and current coupler segments formed as portions of deflector layer 22. Top layer 23 has a thickness of $h_2$.

Top layer 23 may be composed of sub-layers, laminations of more than one material, so as to allow optimization of functions of heat flow management, electrical isolation, and strong bonding of the layers of the cantilevered element 20.

Passivation layer 21 shown in FIGS. 4(*a*) and 4(*b*) is provided to protect the deflector layer 22 chemically and electrically. Such protection may not be needed for some applications of thermal actuators according to the present invention, in which case it may be deleted. Liquid drop emitters utilizing thermal actuators which are touched on one or more surfaces by the working liquid may require passivation layer 21 which is chemically and electrically inert to the working liquid.

A heat pulse is applied to deflector layer 22, causing it to rise in temperature and elongate. Top layer 23 does not elongate nearly as much because of its smaller coefficient of thermal expansion and the time required for heat to diffuse from deflector layer 22 into top layer 23. The difference in length between deflector layer 22 and the top layer 23 causes the cantilevered element 20 to bend upward as illustrated in FIG. 4(*b*). The amount of deflection of the tip end is noted as $D_1$. When used as actuators in drop emitters, the bending response of the cantilevered element 20 must be rapid enough to sufficiently pressurize the liquid at the nozzle. Typically, electroresistive heating apparatus is adapted to apply heat pulses and an electrical pulse duration of less than 4 $\mu$secs is used and, preferably, a duration less than 2 $\mu$secs.

FIGS. 5 through 10 illustrate fabrication processing steps for constructing a single liquid drop emitter according to some of the preferred embodiments of the present invention. For these embodiments the deflector layer 22 is constructed using an electrically resistive material, such as titanium aluminide, and a portion is patterned into a resistor for carrying electrical current, I.

Figure 5:
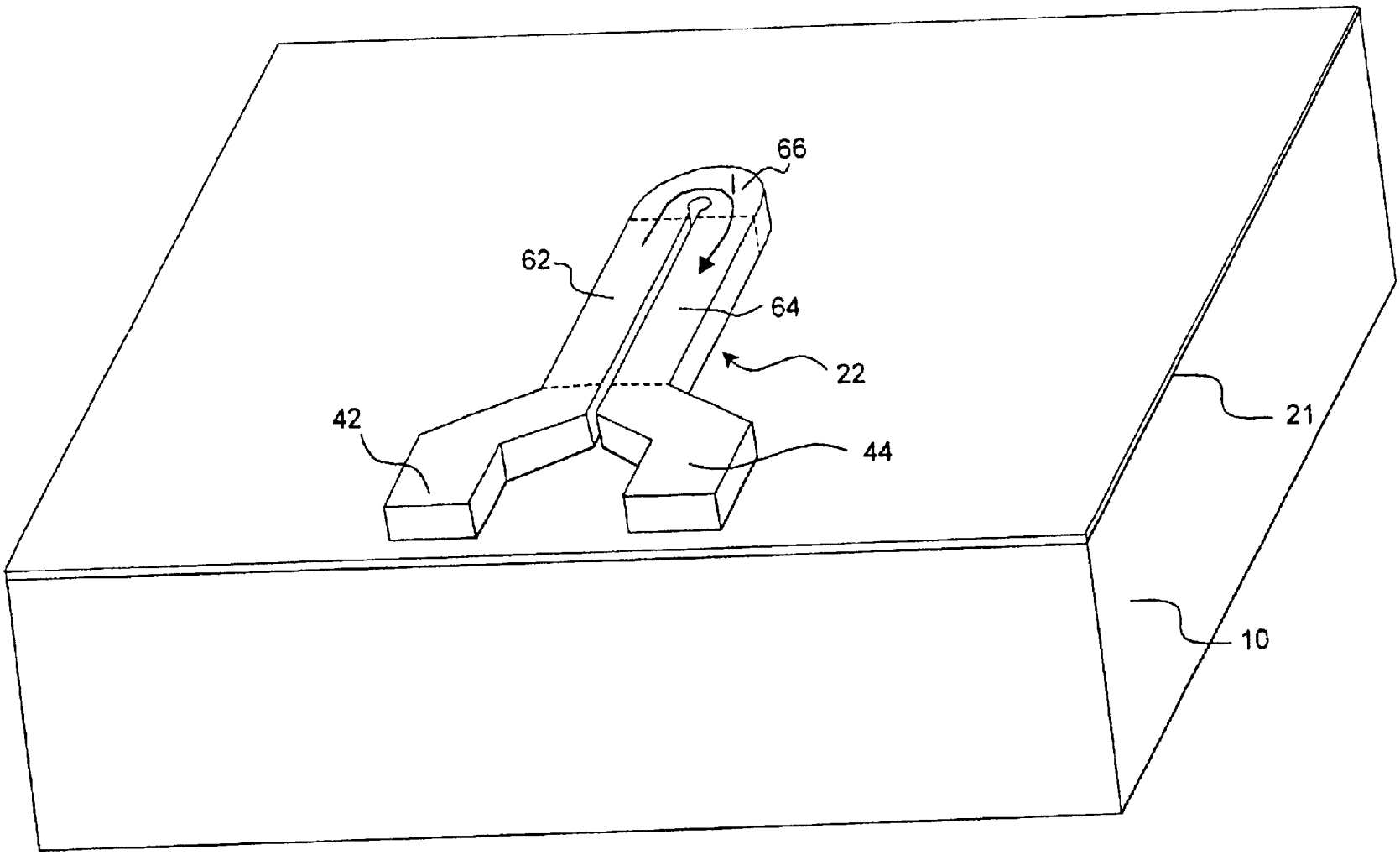
FIG. 5 is a perspective view of the early stages of a process suitable for constructing a thermal actuator according to the present invention wherein a deflector layer of electrically resistive material of the cantilevered element is formed.

FIG. 5 illustrates a deflector layer 22 of a cantilever in a first stage of fabrication. The illustrated structure is formed on a substrate 10, for example, single crystal silicon, by standard microelectronic deposition and patterning methods.

A portion of substrate 10 will also serve as a base element from which cantilevered element 20 extends. Deposition of preferred deflector material intermetallic titanium aluminide may be carried out, for example, by RF or pulsed DC magnetron sputtering. An example deposition process that may be used for titanium aluminide is described in U.S. Pat. No. 6,561,627 for "Thermal Actuator," assigned to the assignee of the present invention.

Deflector layer 22 is deposited with a thickness of $h_1$. First and second resistor segments 62 and 64 are formed in deflector layer 22 by removing a pattern of the electrically resistive material. In addition, a current coupling segment 66 is formed in the deflector layer material which conducts current serially between the first resistor segment 62 and the second resistor segment 64. An arrow and letter "I" indicate the current path. Coupling segment 66, formed in the electrically resistive material, will also heat the cantilevered element when conducting current. However this coupler heat energy, being introduced at the tip end of the cantilever, is not important or necessary to the deflection of the thermal actuator. The primary function of coupler segment 66 is to reverse the direction of current.

Addressing electrical leads 42 and 44 are illustrated as being formed in the deflector layer 22 material as well. Leads 42, 44 may make contact with circuitry previously formed in base element substrate 10 or may be contacted externally by other standard electrical interconnection methods, such as tape automated bonding (TAB) or wire bonding. A passivation layer 21 may be formed on substrate 10 before the deposition and patterning of the deflector layer 22 material. This passivation layer may be left under deflector layer 22 and other subsequent structures or removed in a subsequent patterning process.

Figure 6:
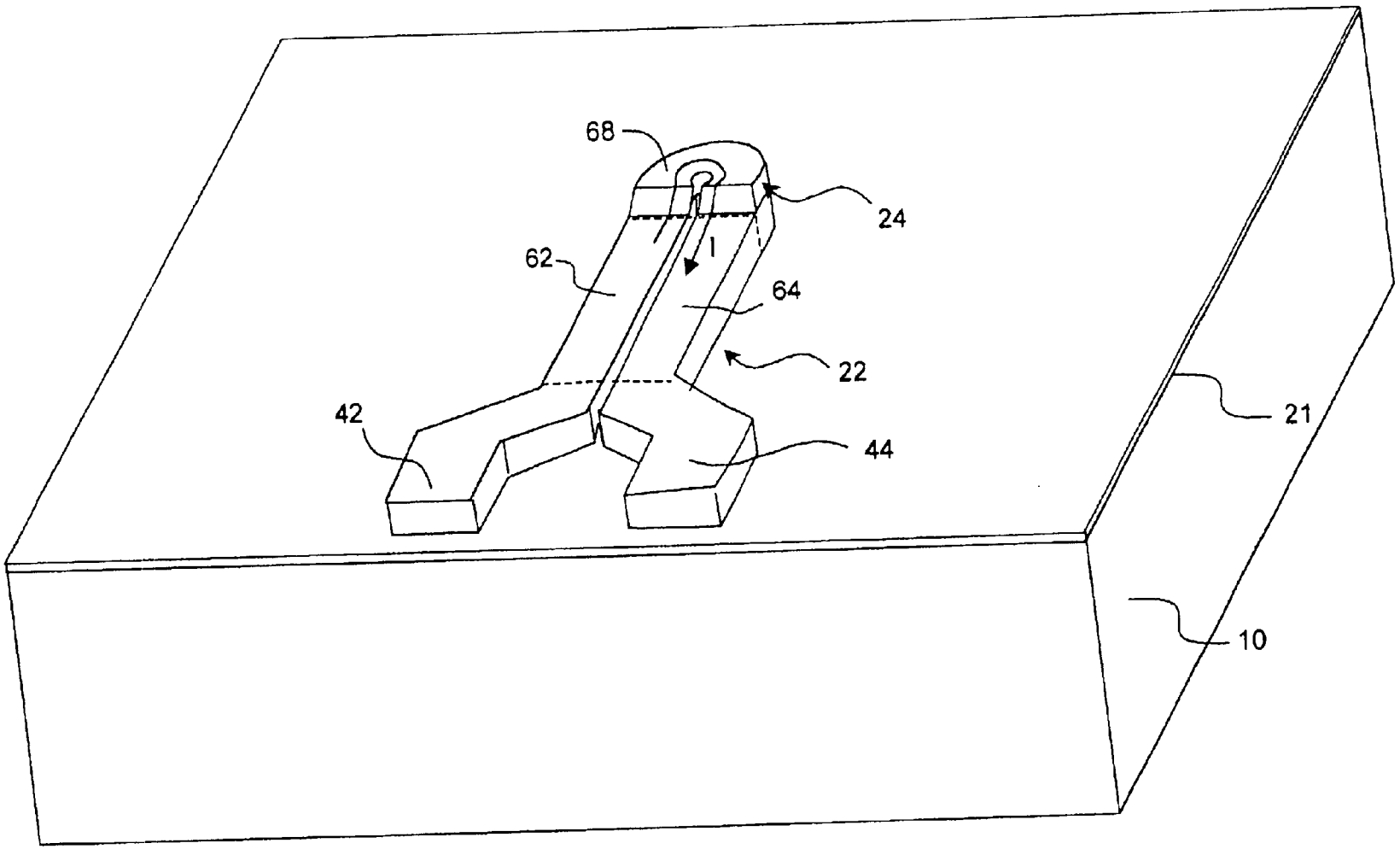
FIG. 6 is a perspective view of a next process stage for some preferred embodiments the present invention wherein a coupler layer of an electrically active material is added and a coupling device formed therein.

FIG. 6 illustrates a next fabrication step for some preferred embodiments of the present inventions. A coupler layer 24, comprised of an electrically active material, is added and patterned into a coupler device 68 which conducts activation current between first and second resistor segments 62 and 64. The electrically active material is preferably substantially more conductive than the electrically resistive material used for deflector layer 22. Typically layer 24 will be formed of a metal conductor such as aluminum. However, overall fabrication process design considerations may be better served by other higher temperature materials, such as silicides, which have less conductivity than a metal but substantially higher conductivity than the conductivity of the electrically resistive material. The purpose of forming the coupler device 68 in a good conductor material is to lower the power density, thereby eliminating debilitating hot spots.

Figure 7:
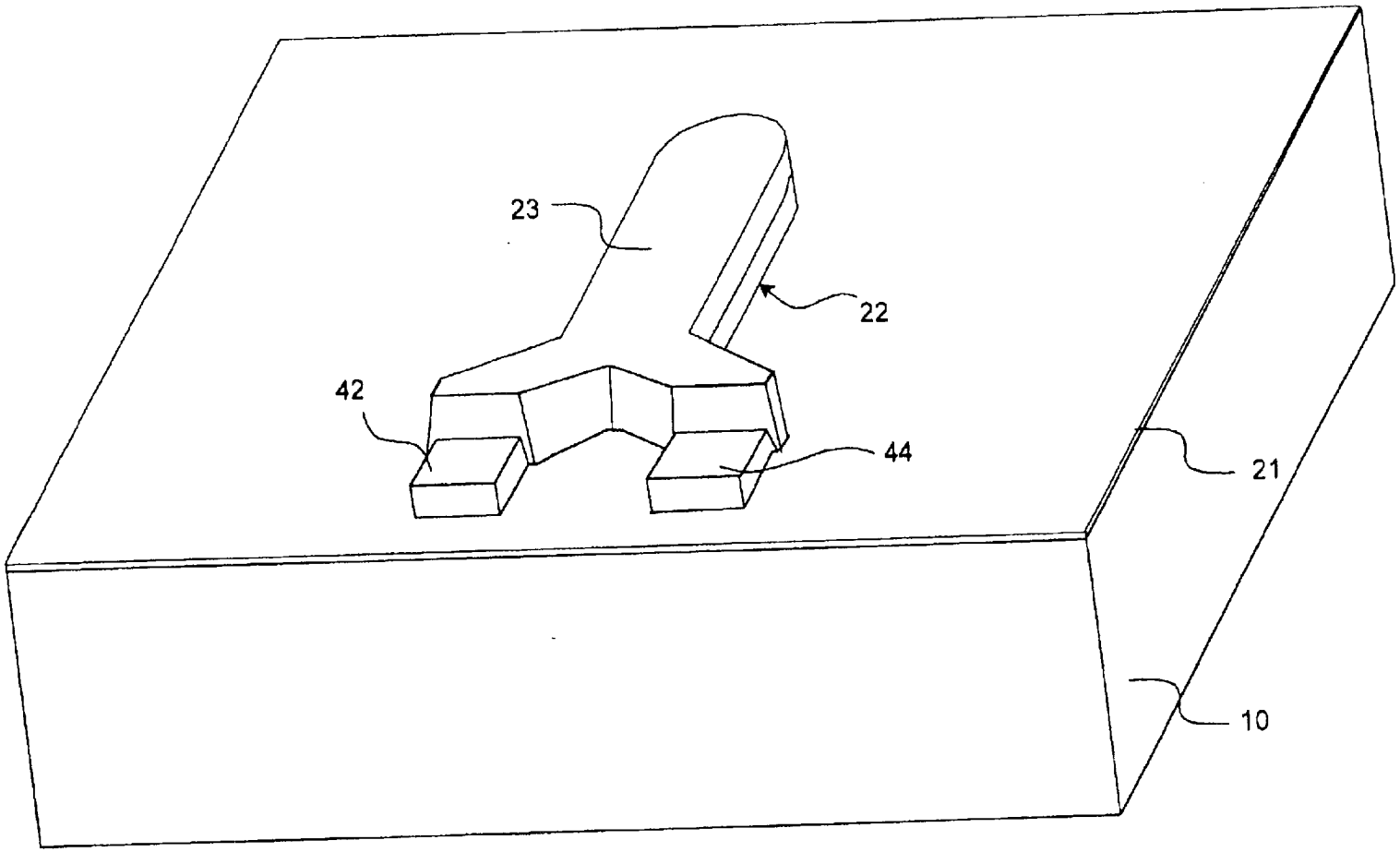
FIG. 7 is a perspective view of the next stages of the process illustrated in FIG. 5 or 6 wherein a top layer of a dielectric material of the cantilevered element is formed.

FIG. 7 illustrates a top layer 23 having been deposited and patterned over the previously formed deflector layer 22 portion of the thermal actuator. For the alternate embodiment illustrated in FIG. 6, top layer 23 would also cover the coupler device portion of a remaining layer 24. Top layer 23 is formed over the deflector layer 22 covering the remaining resistor pattern. Top layer 23 is deposited with a thickness of $h_2$. The top layer 23 material has low coefficient of thermal expansion compared to the material of deflector layer 22. For example, top layer 23 may be silicon dioxide, silicon nitride, aluminum oxide or some multi-layered lamination of these materials or the like.

Additional passivation materials may be applied at this stage over the top layer 23 for chemical and electrical protection. Also, the initial passivation layer 21 is patterned away from areas through which fluid will pass from openings to be etched in substrate 10.

Figure 8:
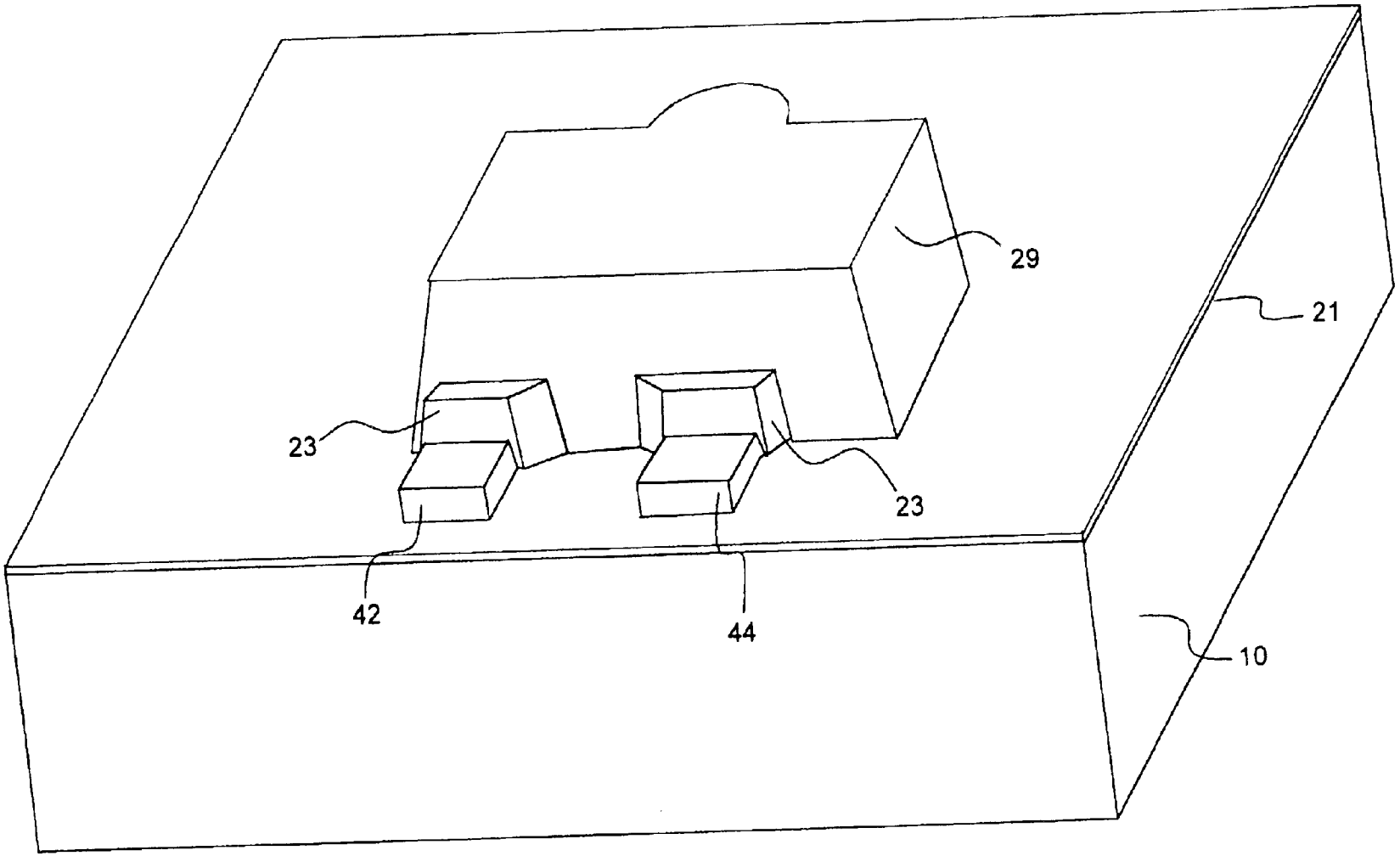
FIG. 8 is a perspective view of the next stages of the process illustrated in FIGS. 5–7 wherein a sacrificial layer in the shape of the liquid filling a chamber of a drop emitter according to the present invention is formed.

FIG. 8 shows the addition of a sacrificial layer 29 which is formed into the shape of the interior of a chamber of a liquid drop emitter. A suitable material for this purpose is polyimide. Polyimide is applied to the device substrate in sufficient depth to also planarize the surface that has the topography of the deflector 22, top 23 and optional coupler 24 layers as illustrated in FIGS. 5–7. Any material which can be selectively removed with respect to the adjacent materials may be used to construct sacrificial structure 29.

Figure 9:
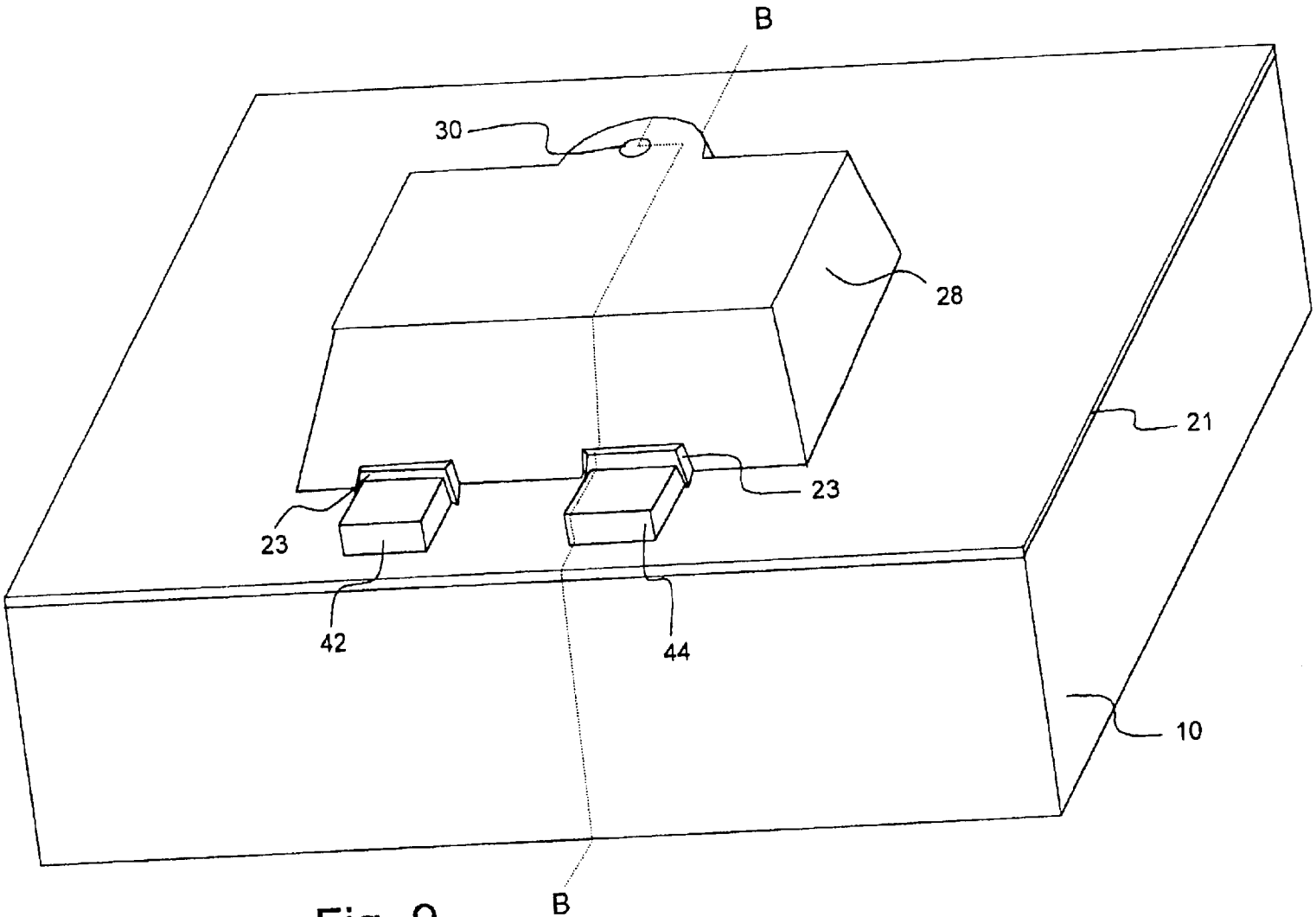
FIG. 9 is a perspective view of the next stages of the process illustrated in FIGS. 5–8 wherein a liquid chamber and nozzle of a drop emitter according to the present invention is formed.

FIG. 9 illustrates drop emitter liquid chamber walls and cover formed by depositing a conformal material, such as plasma deposited silicon oxide, nitride, or the like, over the sacrificial layer structure 29. This layer is patterned to form drop emitter chamber 28. Nozzle 30 is formed in the drop emitter chamber, communicating to the sacrificial material layer 29, which remains within the drop emitter chamber 28 at this stage of the fabrication sequence.

Figure 10A:
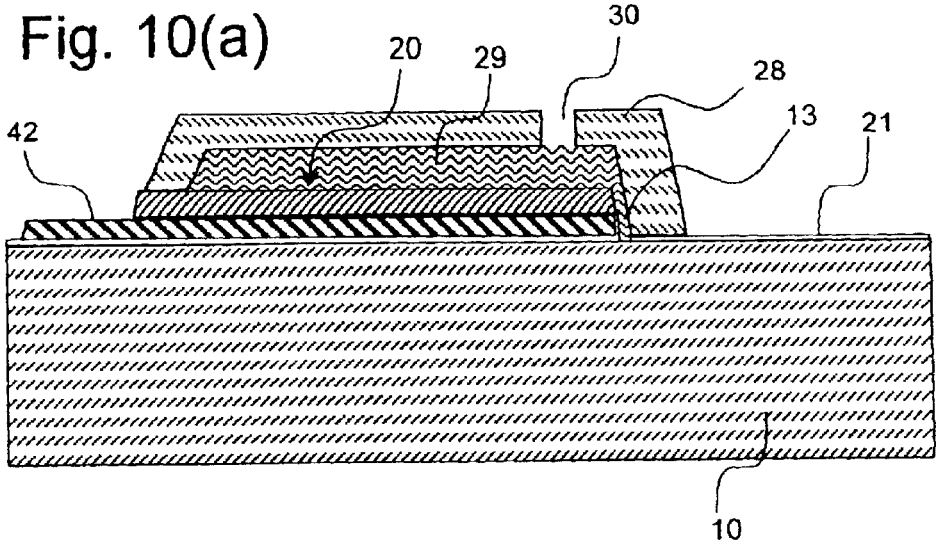
FIGS. 10(*a*), 10(*b*) and 10(*c*) are side views of the final stages of the process illustrated in FIGS. 5–9 wherein a liquid supply pathway is formed and the sacrificial layer is removed to complete a liquid drop emitter according to the present invention.
Figure 10B:
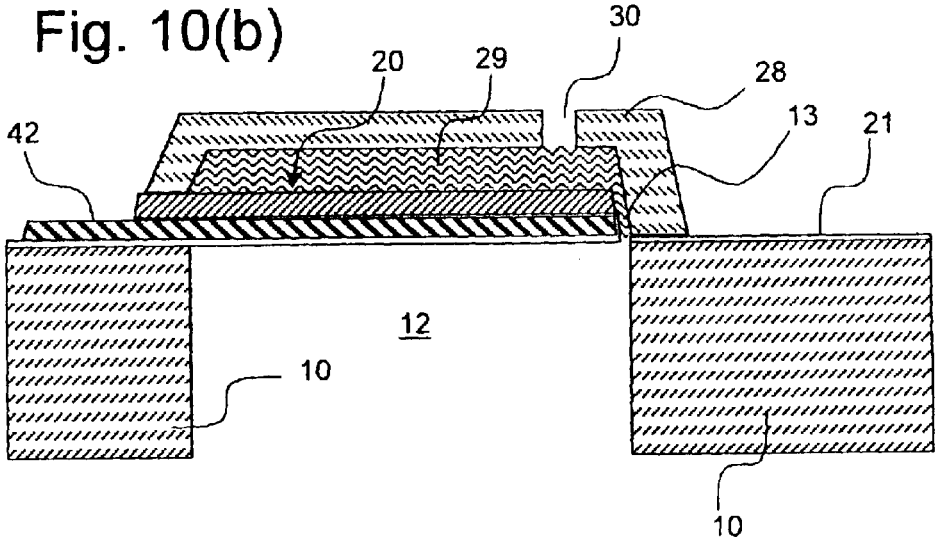
Figure 10C:
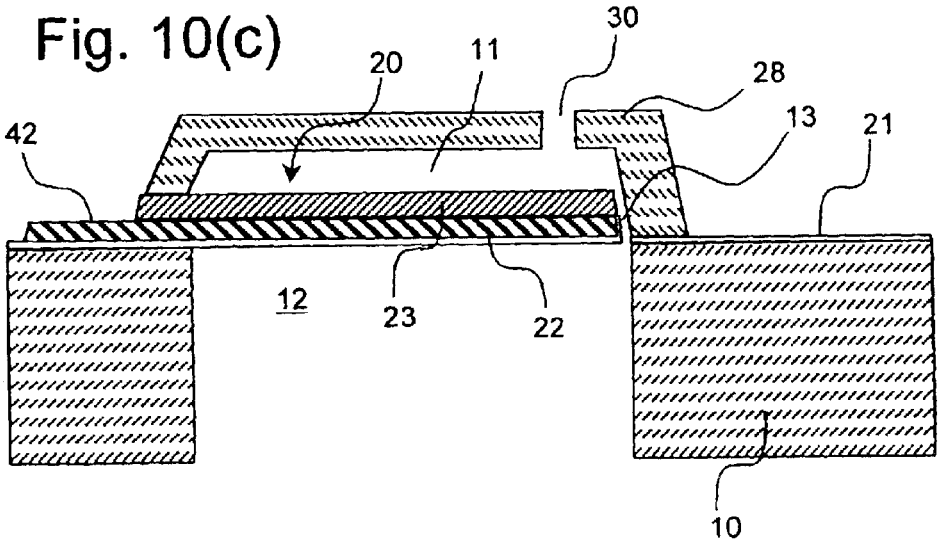

FIG. 10 shows a side view of the device through a section indicated as A—A in FIG. 9. In FIG. 10(*a*) the sacrificial layer 29 is enclosed within the drop emitter chamber walls 28 except for nozzle opening 30. Also illustrated in FIG. 10(*a*), the substrate 10 is intact. Passivation layer 21 has been removed from the surface of substrate 10 in gap area 13 and around the periphery of the cantilevered element 20. The removal of layer 21 in these locations was done at a fabrication stage before the forming of sacrificial structure 29.

In FIG. 10(*b*), substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element 20.

In FIG. 10(*c*) the sacrificial material layer 29 has been removed by dry etching using oxygen and fluorine sources. The etchant gasses enter via the nozzle 30 and from the newly opened fluid supply chamber area 12, etched previously from the backside of substrate 10. Tis step releases the cantilevered element 20 and completes the fabrication of a liquid drop emitter structure.

Figure 11A:
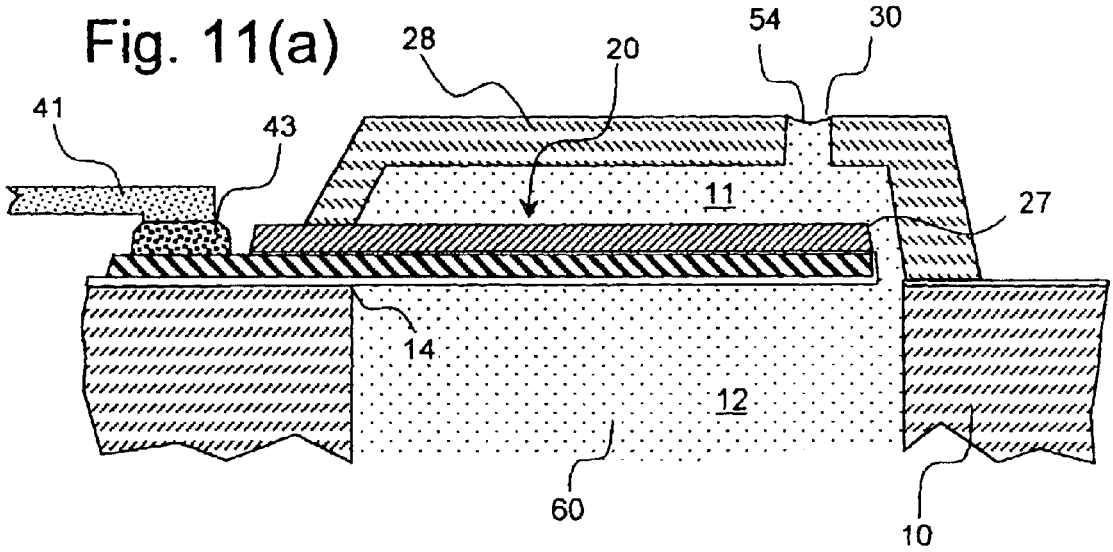
FIGS. 11(*a*) and 11(*b*) are side views illustrating the operation of a drop emitter according the present invention.
Figure 11B:
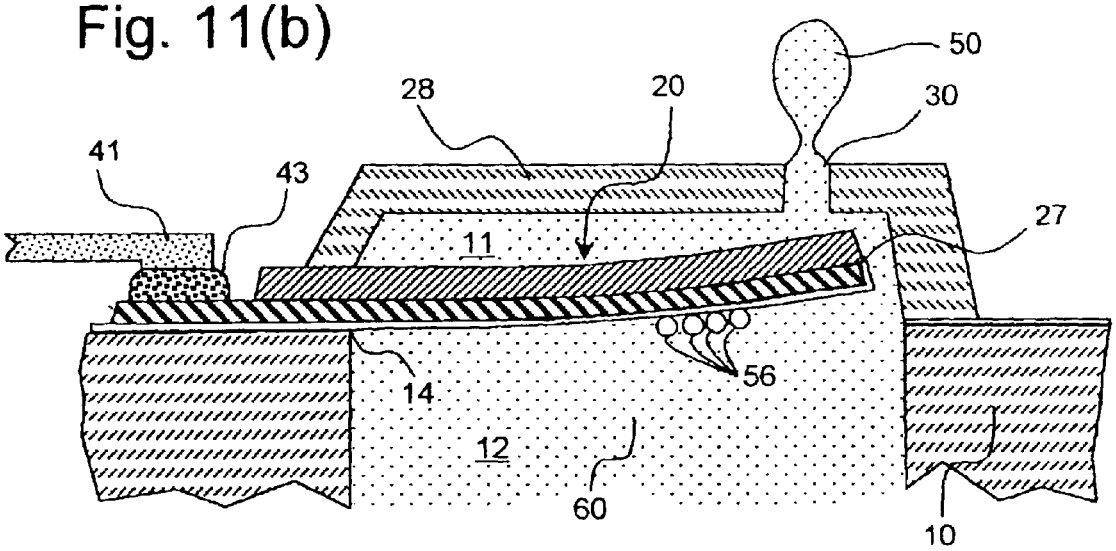

FIG. 11 illustrates a side view of a liquid drop emitter structure according to some preferred embodiments of the present invention. FIG. 11(*a*) shows the cantilevered element 20 in a first position proximate to nozzle 30.

FIG. 11(*b*) illustrates the deflection of the free end 27 of the cantilevered element 20 towards nozzle 30. Rapid deflection of the cantilevered element to this second position pressurizes liquid 60 causing a drop 50 to be emitted.

In an operating emitter of the cantilevered element type illustrated, the quiescent first position may be a partially bent condition of the cantilevered element 20 rather than the horizontal condition illustrated FIG. 11(*a*). The actuator may be bent upward or downward at room temperature because of internal stresses that remain after one or more microelectronic deposition or curing processes. The device may be operated at an elevated temperature for various purposes, including thermal management design and ink property control. If so, the first position may be as substantially bent as is illustrated in FIG. 11(*b*).

For the purposes of the description of the present invention herein, the cantilevered element will be said to be quiescent or in its first position when the free end is not significantly changing in deflected position. For ease of understanding, the first position is depicted as horizontal in FIG. 4(*a*) and FIG. 10(*a*). However, operation of thermal actuators about a bent first position are known and anticipated by the inventor of the present invention and are fully within the scope of the present inventions.

FIGS. 5 through 10 illustrate a preferred fabrication sequence. However, many other construction approaches may be followed using well known microelectronic fabrication processes and materials. For the purposes of the present invention, any fabrication approach which results in a cantilevered element including a deflector layer 22, a top layer 23 and optional coupler layer 24 may be followed. Further, in the illustrated sequence of FIGS. 5 through 10, the liquid chamber 28 and nozzle 30 of a liquid drop emitter were formed in situ on substrate 10. Alternatively a thermal actuator could be constructed separately and bonded to a liquid chamber component to form a liquid drop emitter.

The inventor of the present inventions have found that thermal actuators, working in contact with a liquid, may cause the generation of vapor bubbles or air dissolution bubbles, which first appear at the locations of highest power density within the heater resistor configuration. FIG. 11(*b*) illustrates this observed bubble formation 56 located adjacent the passivation layer 21 adjacent the deflector layer 22 of cantilevered element 20. Such bubble formation is highly undesirable for the predictable and reliable performance of the device. It is not believed practical to operate a thermo-mechanical actuator device in a liquid for acceptable numbers of cycles if accompanied by vapor bubble generation at hot spots.

For a variety of practical considerations, including liquid chemical safety, temperature limits of organic material components used in working liquids and in device fabrication, upper temperature limits for hot spots are likely to be in the range of 300° C. to 450° C. Water is the most common solvent in working liquids used with MEMS devices, primary because of environmental safety ease-of-use. Many large organic molecules, such as dyes used for ink jet printing, will decompose at temperatures above 300° C. Most organic materials used as adhesives or protective coatings will decompose at temperatures above 450° C.

On the other hand, the deflection force that may be generated by a practically constructed cantilevered element thermal actuator is directly related to the amount of pulsed temperature rise that can be utilized. This temperature increase is directly related to the nominal power density that is applied to the actuation resistors, first and second resistor segments 62 and 64 in FIG. 5, for example. Typically, 50° C. of temperature rise would be a minimum level to provide a useful amount of mechanical actuation in a MEMS-based thermal actuator. More preferably, 100° C.–150° C. of pulsed temperature increase is desirable for thermal actuators used in liquid drop emitters such as ink jet printheads.

The inventor of the present inventions have found that the peak temperatures reached during a useful actuation may be reduced significantly by applying the needed heat energy in the form of multiple pulses, delayed appropriately in time, according the physical processes involved in the device application. For example, in the case of a drop-on-demand liquid drop emitter, the motion of the thermal actuator must be initially rapid to create a strong pressure impulse to accelerate and "jet" the working fluid from the nozzle. However, the actuator must then pause or continue moving forward, and not retreat, for sufficient time for surface tension and viscosity mechanisms to cause formation of a drop of the intended volume on the fluid jet column.

For other applications of thermo-mechanical actuators, such as for switches, fluid valves, light deflectors, and so on, a similar need for a rapid initial movement from a first position, followed by a pause or dwelling at a second position, may be necessary to complete the actuation event.

The inventor of the present inventions has found that a single activation pulse of heat energy may accomplish the necessary rapid rise and subsequent dwell or pause of a thermo-mechanical actuator. However, in order to achieve the needed pause time, it is necessary to add enough extra heat to account for any cooling processes that may be operating. For example, in the case of a liquid drop emitter, it may be necessary to input heat energy within 2 microseconds in order to achieve the pressure impulse needed to form a jet with sufficient velocity. On the other hand, the drop formation process on the jet ray require 3 to 6 microseconds before the jet pressure can be reversed. It is conventional practice to input enough heat energy in a single pulse to "over" drive the temperature of the thermal actuator so that it does not cool down and reverse direction during the drop formation process. This practice leads to problems of unreliability due to generation of vapor bubbles, excessive air dissolution from the working liquid, and added thermal cycle fatigue of materials and layer interfaces in the device.

The inventor of the present inventions has found that liquid drop emitters of the present inventions may be optimally operated by first determining, experimentally or via model calculations, the input pulse power and energy conditions that cause an acceptable sudden movement of a thermal actuator away from a quiescent first position. Then, after an initial pulse to initiate the actuator motion, additional energy may be added in smaller energy pulses to keep the actuator moving, or to cause it to pause, for the time required for the completion of the physical process involved. It has been found that by using this multiple pulse approach to an actuation, the same amount of energy, or perhaps less, may be used, however, the peak temperature reached by the thermo-mechanical element can be substantially less.

Figure 12:
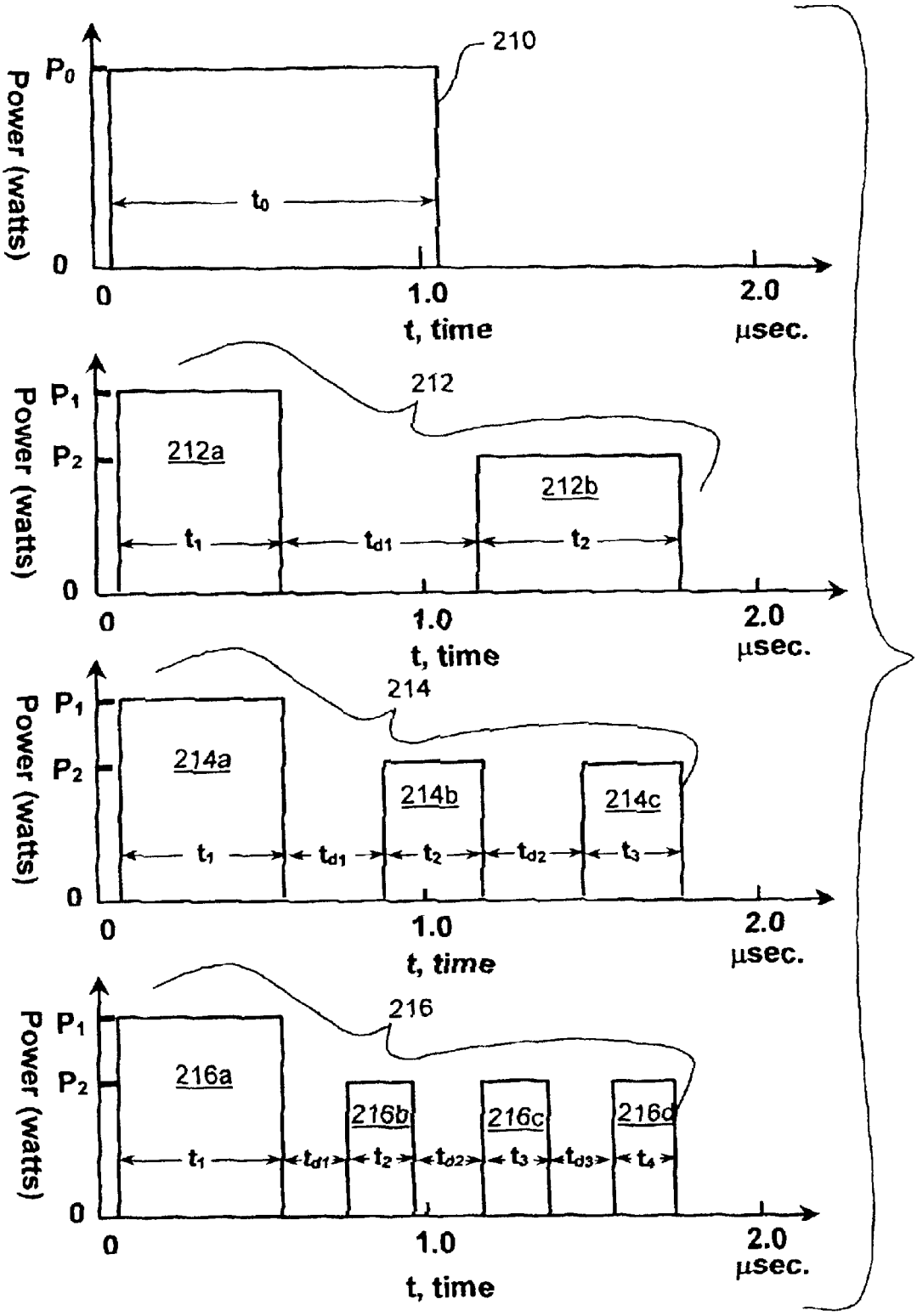
FIG. 12 is an illustrative drawing of several actuation energy pulse alternatives for operating a thermal actuator, including some methods according to the present inventions.

FIG. 12 illustrates four activation pulse alternatives in which 1, 2, 3 or 4 energy pulses are applied to a cantilevered element thermal actuator used in a liquid drop emitter such as those illustrated in above FIGS. 1–11(*b*). Pulse 210 is a conventional single pulse applying having enough energy, $E_0=P_0t_0$, where $P_0$ is the input power and $t_0$ is the energy pulse time, to eject a drop of targeted volume and velocity. Pulses 212, 214, and 216 are multiple pulse actuation sequences, associated with three possible embodiments of the present inventions. For these alternative pulse sequences a first main pulse (212*a*, 214*a*, or 216*a*) has enough energy to cause the needed initial rapid movement of the thermal actuator. Then second pulses (212*b*, 214*b*, or 216*b*) add additional energy after a fast delay time $t_{di}$. Pulse sequences 214 and 216 apply third pulses (214*c* and 216*c*) after a second delay time $t_{d2}$. Pulse sequence 216 applies a fourth pulse 216*c* after a third delay time $t_{d3}$.

In principle, activation energy pulse sequences, according to the present inventions, may be constructed having a main first energy pulse followed by a plurality of n sub-pulses, each followed by an appropriate time delay. For the example pulse sequences illustrated in FIG. 12, n=1, 2 or 3 for activation sequences 212, 214 or 216, respectively. Multiple pulse sequences are constructed to apply a first large energy to begin the rapid movement of a thermal actuator away from its first, quiescent, position. Then trailing pulses are applied to keep the actuator moving to, or paused at, a second position according to the physical effects required for a successful actuation. The trailing pulses have sufficient energy and are timed so that the thermal actuator does not cool sufficiently to slow down prematurely and disrupt the droplet ejection.

For the pulse sequences in FIG. 12, the first pulses (212*a*, 214*a*, and 216*a*) have a same first energy, $E_1=P_1t_1$. Trailing pulses are then applied at a different power $P_2$ and for different pulse times in order to spread out the application of energy. To first order, all three multiple pulse sequences apply the same amount of energy, differing only in the timing of the energy added following a same first energy pulse. The inventor of the present inventions recognizes that the trailing energy may be applied in many pulse sequence variations of differing power levels, pulse time duration's, and delay times. All of these variations are contemplated as embodiments of the present inventions. All cause the activation of the thermal actuator by applying a first energy pulse that begins the movement of the moveable portion and then follow with one or more energy pulses that keep the actuator moving or paused in order to successfully accomplish the physical process being actuated. The pulse sequence is selected to keep the thermal actuator from exceeding a predetermined maximum temperature, $T_{max}$, for reliable operation.

Figure 13:
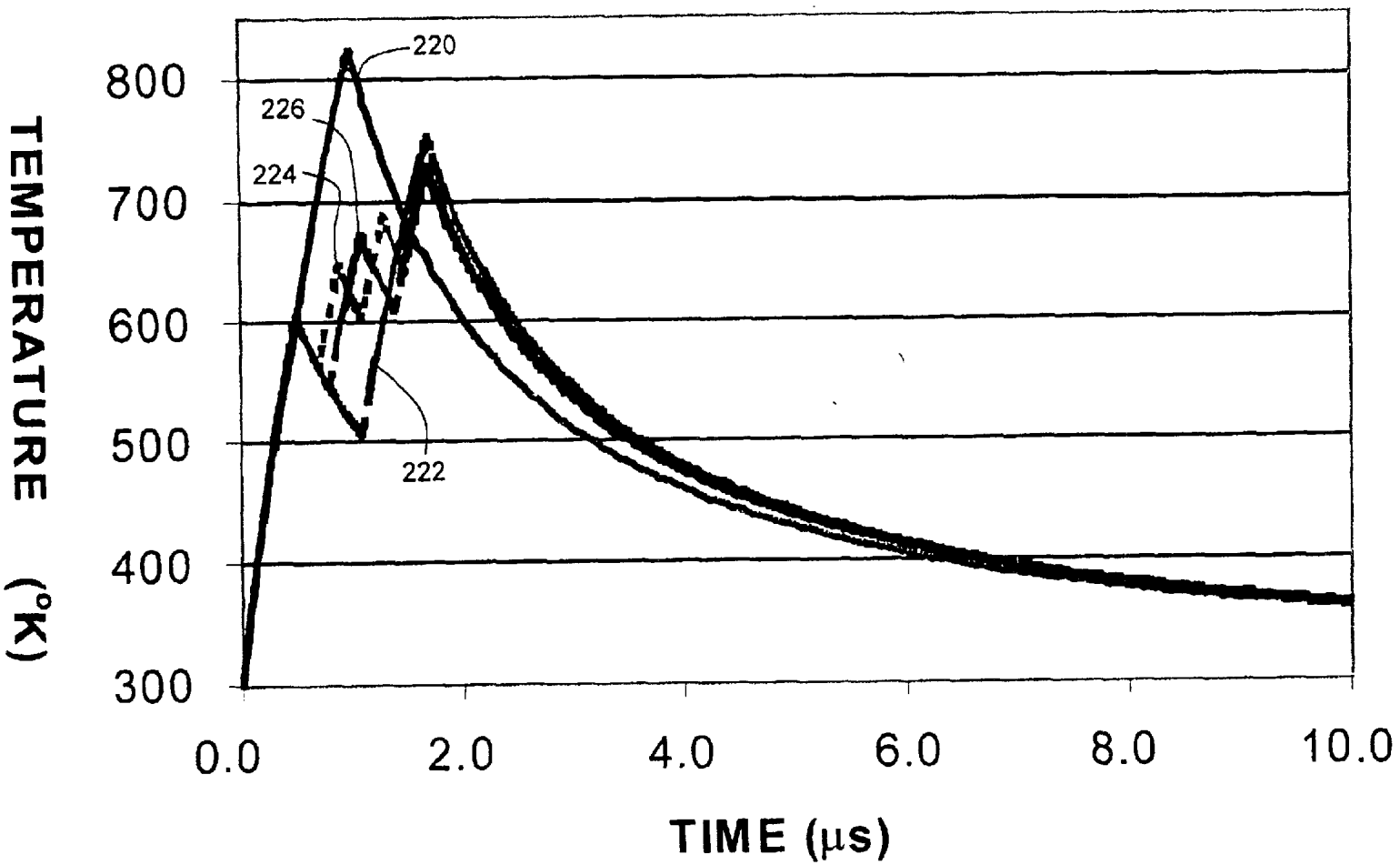
FIG. 13 shows computer model calculations of the temperature reached by a cantilevered element thermal actuator when activated by pulses as illustrated in FIG. 12.

FIG. 13 shows results for model calculations of the peak temperatures reached by a cantilevered element thermal actuator sized appropriately for a liquid drop emitter which emits drops of approximately 3 picoLiters (pL), when activated by each of the pulse sequences of FIG. 12. Curve 220 in FIG. 13 is the calculated temperature resulting from applying the conventional single pulse, 210, from FIG. 12. Curve 222 in FIG. 13 is the calculated temperature occurring when activated by double pulse sequence 212 in FIG. 12; curve 224 results from a triple pulse sequence 214; and curve 226 results from a quadruple pulse sequence 216.

The temperature versus time curves in FIG. 13 all overlie each other during the first half microsecond. That is, the multiple energy pulse sequences 212, 214, and 216 according to the present inventions create the same temperature rise in the thermal actuator, as does the conventional single pulse of energy, curve 220. This means that the thermo mechanical effects in the actuator will be the same. The same acceleration and movement of the moveable portion of the thermo-mechanical element will occur during the first half microsecond. The peak temperature performance calculated is thereafter significantly different.

The conventional single energy pulse may be seen from FIG. 13 to cause the temperature to steadily rise to ~825° K at the end of the first microsecond, corresponding to the time of application of the power $P_0$, i.e. $t_0$. Thereafter, the thermo-mechanical element cools according to the various mechanisms available for heat transfer: to nearby layers, to the device substrate, to the working liquid, to the device package, and radiated to the environment. In all likelihood the peak temperature of ~825° K, ~550° C., will be too high for reliable operation of a liquid drop emitter, especially when the working liquid is an aqueous formulation. Even though this temperature is reached for only a fraction of a microsecond, it is likely to cause the boiling of a film of liquid immediately adjacent the thermo-mechanical element, as is illustrated in FIG. 11(*b*). Generation of vapor bubbles at the thermo-mechanical actuator is undesirable because it causes erratic motion of the actuator and, also, may cause "cavitation" damage when the vapor bubbles violently collapse. Further, some components of the working liquid, such as the dyes used in ink jet inks, may degrade at the high temperatures and deposit residues on the thermal actuator, a process called "kogation" by thermal ink jet workers.

The multiple energy pulse activation sequences 212, 214, or 216 illustrated result in a decrease in the peak temperature reached. While somewhat difficult to distinguish in FIG. 13, the temperature curves may be identified by the number of temperature peaks, one for each energy pulse in the sequence. The four pulse sequence 216 in FIG. 12, results in a peak temperature rise of ~725° K at the end of the fourth energy pulse 216*d* (see curve 226 in FIG. 13), 100° K (or ° C.) lower than the conventional single pulse activation (see curve 220 in FIG. 13). This significant lowering of the peak temperature is very important in avoiding the formation of vapor bubbles and other materials failure modes associated with high temperature excursions.

Figure 14:
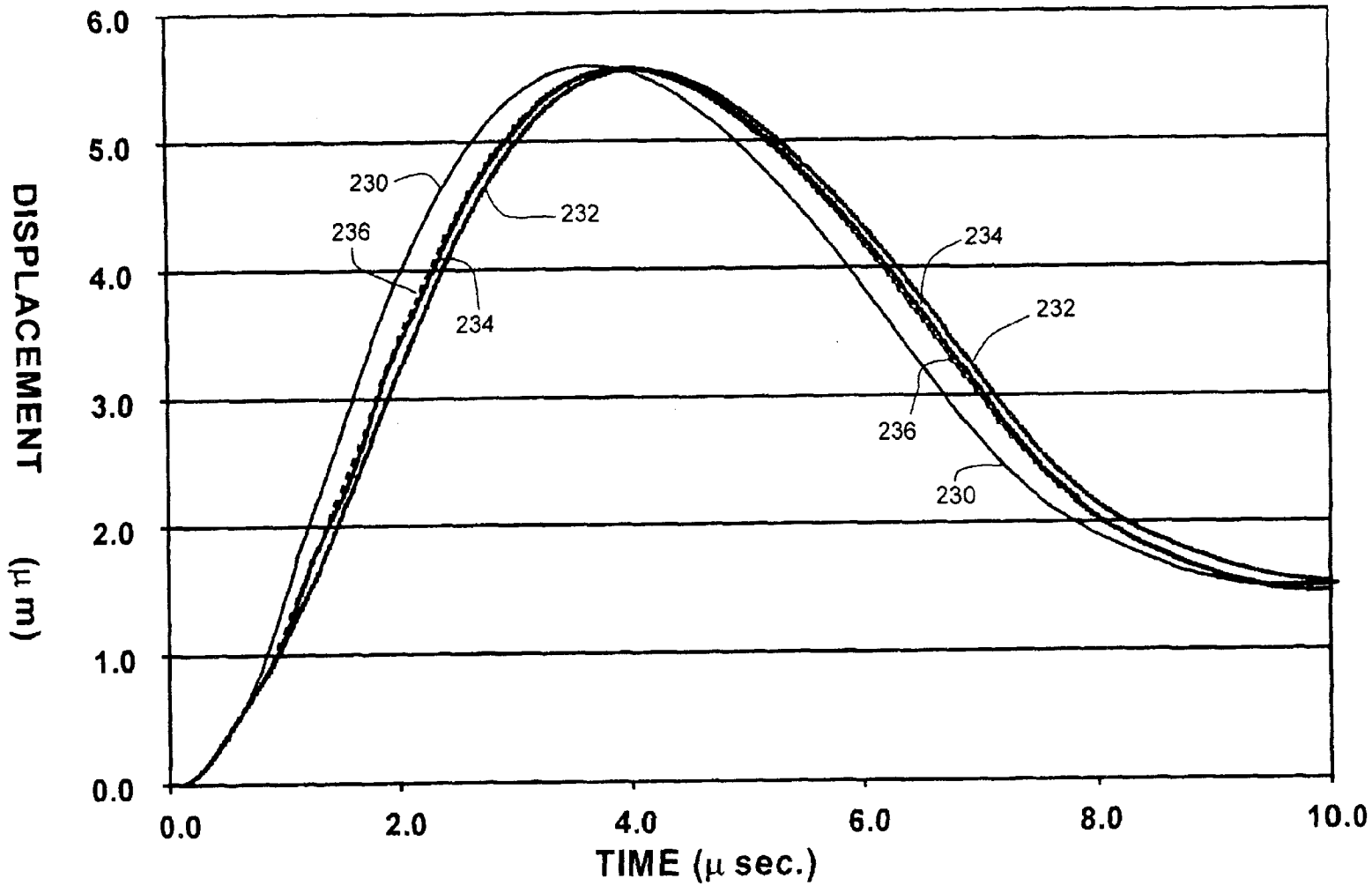
FIG. 14 shows computer model calculations of the displacement of the free end of a cantilevered element thermal actuator when activated by pulses as illustrated in FIG. 12.

FIG. 14 shows companion model calculations of the displacements of the free end of a cantilevered thermal element, calculated for the same thermo-mechanical actuator and activation pulse sequences illustrated in FIGS. 12 and 13. Curve 230 shows the calculated movement of the thermal actuator free end in response to the conventional single energy pulse 210 of FIG. 12. Curves 232, 234, and 236 show the displacement response to the multiple energy pulse sequences 212, 214, and 216, respectively. It may be seen that the four different energy application methods produce neatly the same overall movement of the thermal actuator. The multiple pulse sequences result in slightly delayed movement, ~0.4 $\mu$sec, however the peak displacement, 5.6 $\mu$m, is the same.

Note that the displacement time plots do not show the multiple peaks that are calculated for the temperature time plots. This is because the physical processes involved in the thermo-mechanical motion do not have the "bandwidth" to follow temperature changes on a sub-microsecond time scale. In similar fashion the fluid mechanical physical processes involved in forming a jet of liquid and the necking down into individual droplets of liquid further "smooth" the differences seen in the displacement plots. As a result the multiple energy pulse activation sequences of the present inventions result in nearly "equal" drop emission performance to the convention single energy pulse activation. However, the multiple energy pulse sequences may accomplish the desired drop emission characteristics while keeping the peak temperature reached by the thermo-mechanical element at a substantially lower value than would be possible using conventional single energy pulse activation.

Figure 15:
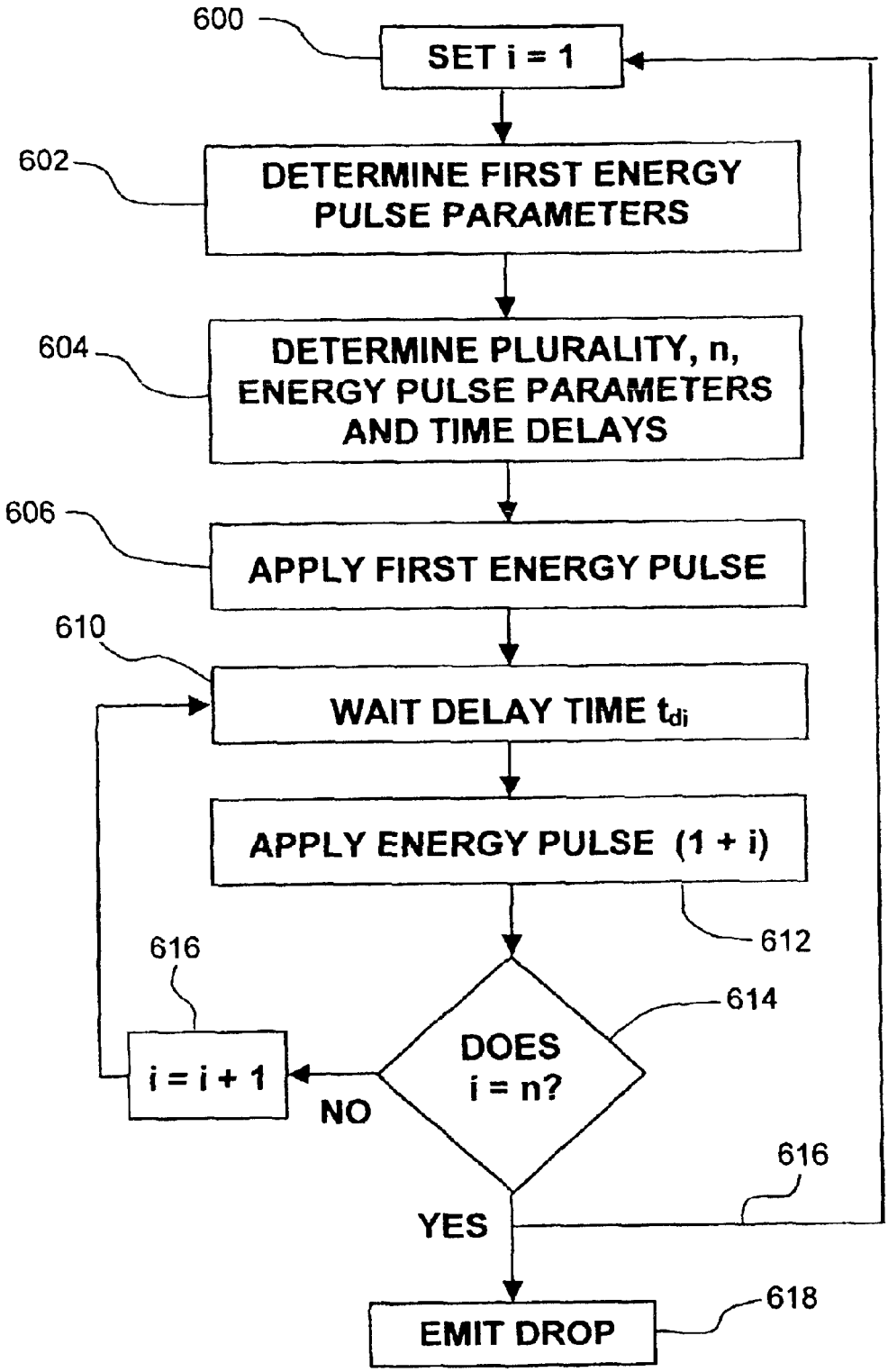
FIG. 15 is a schematic illustration of a preferred method of operating a liquid drop emitter according to an embodiment of the present inventions.

FIG. 15 is a schematic illustration of the methods of the present invention. A generalized multiple energy pulse activation is covered by the flow diagram. A first energy pulse ($E_1$, $t_1$) followed by a plurality (n) of pulses ($E_{1+i}$, $t_{1+1}$, $t_{di}$, i=1 to n) is designed to achieve the desired physical activation while not exceeding a maximum temperature, $T_{max}$. The pulse energies and relative timings are first determined and then applied to the thermo-mechanical actuator, in this example, for a liquid drop emitter. For example, the method of FIG. 15 results in energy pulse sequences 212, 214, or 216, illustrated in FIG. 12, for the case of n =1, 2 or 3, respectively.

The method flow diagram of FIG. 15 allows for the determination of these energy pulse parameters for each activation of the thermal actuator. For some applications of the present inventions, the multiple energy pulse parameters may be fixed, the same, for all activations. However, there may be situations in which the parameters are adjusted based on time-varying factors such as previous activation history, changes in fluid properties, environmental conditions, and so on. The methods of the present inventions contemplate that a multiple pulse sequence will be determined and applied to the thermal actuator that provides the appropriate first energy pulse to begin the actuator movement, followed by appropriate trailing energy pulses to keep the actuator moving forward, or paused, to allow the desired physical processes to occur. As various system conditions change, some or all of the power and timing parameters may need to be changed for an activation energy pulse sequence, to accomplish this overall intention.

The optimal timing of the application of energy pulse sequences may also be affected by the characteristic mechanical resonant behaviors of the moveable portion of a thermo-mechanical element. For example, a cantilevered element thermo-mechanical actuator will exhibit a damped resonant oscillation following an initial thermal excitation pulse. Referring to FIGS. 4(*a*) and (*b*), cantilevered element 20 will quickly relax from the bent position illustrated in FIG. 4(*b*) as layers 22 and 21, 23 equilibrate in temperature, as heat is transferred to the working fluid and substrate 10, and due to mechanical restoring forces set up in layers 21, 22 and 23. The relaxing cantilevered element 20 will over shoot the quiescent state, FIG. 4(*a*), and bend downwards (not shown). Cantilevered element 20 will continue to "ring" in a resonant oscillatory motion until damping mechanisms, such as internal friction and working fluid resistance, deplete and convert all residual mechanical energy to heat.

If predictable drop volume and velocities are important for the application, the damped resonant oscillation effects described above must be considered in designing the operating method. Applying heat energy pulses at arbitrary times during the resonant oscillations may cause intended drop volumes and intended drop velocities to vary unacceptably. The present inventive methods of operating a liquid drop emitter preferably are carried out so as to avoid complications arising from intrinsic damped resonant oscillations of the cantilevered element. This is accomplished by selecting the overall duration of the activation pulse sequence, $t_A$, to be less than one-quarter cycle of the period of the fundamental resonant mode, $\tau_R$, of the moveable portion of the thermo-mechanical element.

Figure 16:
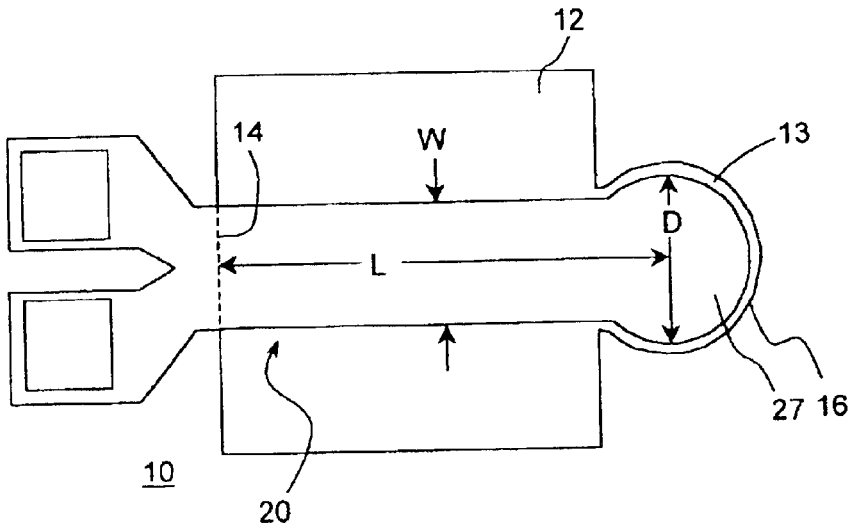
FIG. 16 conveys data showing the fundamental resonance frequency and damping time constant for several geometries of cantilevered element thermal actuators.
Figure 17:
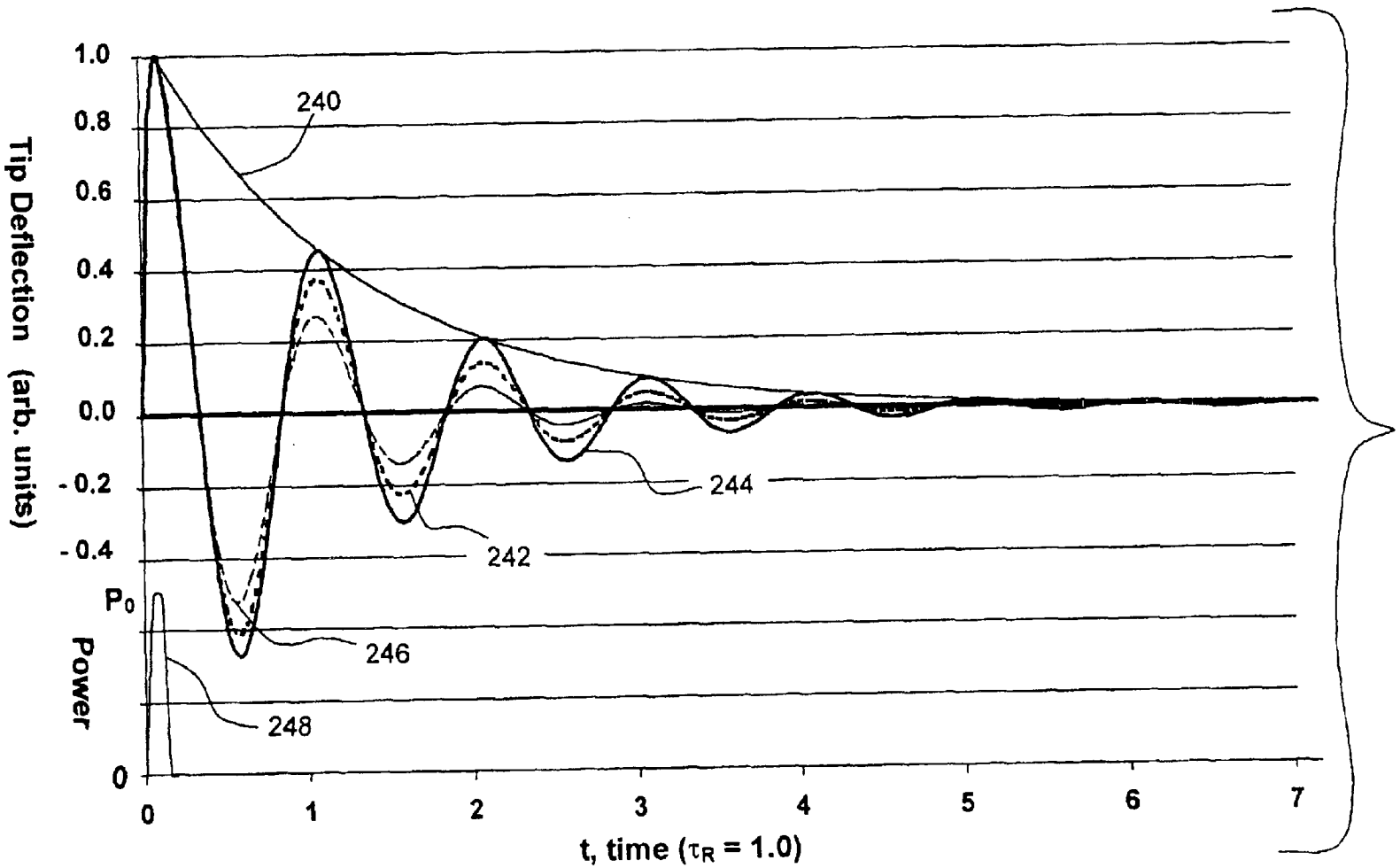
FIG. 17 illustrates damped resonant oscillation of a cantilevered element thermal actuator for several values of the damping time constant.

FIGS. 16 and 17 illustrate damped resonant oscillation of the free end 27 of a cantilevered element 20 moving in its fundamental resonance mode. FIG. 16 discloses experimental data for several parameter variations of the general thermo-mechanical actuator configuration illustrated in FIGS. 3(*a*)–3(*b*). The table in FIG. 16 discloses the observed fundamental resonant frequency, F, the period of the fundamental resonance, $\tau_R$, and the damping time constant, $\tau_D$, for several different configurations of the cantilevered element length, L, width, W, and free end diameter, D. The damped resonant behavior disclosed was measured with water as the working fluid.

Free end displacement, y(L,t), is plotted in FIG. 17 as a function of time, t, according to Equation 6:

$$y(L,t)=\sin(2\pi t/\tau_R)\exp(-t/\tau_D). \quad (6)$$

where $\tau_R$ is the period of the fundamental resonant oscillation mode and $\tau_D$ is the time constant of damping factors. The maximum magnitude of displacement is normalized to 1.0. The time axis in FIG. 17 is divided in units of $\tau_R$. Curves 246, 242, and 244 show damped resonant oscillations all having the same resonant period $\tau_R$, but having damping time constant $\tau_d$=0.75$\tau_R$, 1.0 $\tau_R$, and 1.25 $\tau_R$, respectively. Curve 240 shows the exponential damping portion of Equation 6 for the case of curve 244. Curve 248 illustrates the conventional single electrical pulse that activated the thermo-mechanical activators initially. Activation pulse duration, $\tau_p$, should be less than one-quarter the resonant period, i.e. $\tau_p$<¼ $\tau_R$, to avoid the situation of contention between the natural spring recoil of the cantilevered element and the thermo-mechanical force introduced by the input heat energy pulse.

The geometrical parameters for cantilevered elements given in the table of FIG. 16 are typical of liquid emitter devices that are appropriate for high quality ink jet printing and other liquid drop emitter applications utilizing drop volumes of approximately 10 pL or less. The highest resonant frequency of these experimental devices was found to be 74 kHz, having a period of 13.5 μsec. Consequently, it is preferred to operate such a liquid drop emitter according to the present inventions by insuring that all input heat pulses have a time duration of approximately 3 μsec or less.

Figure 18:
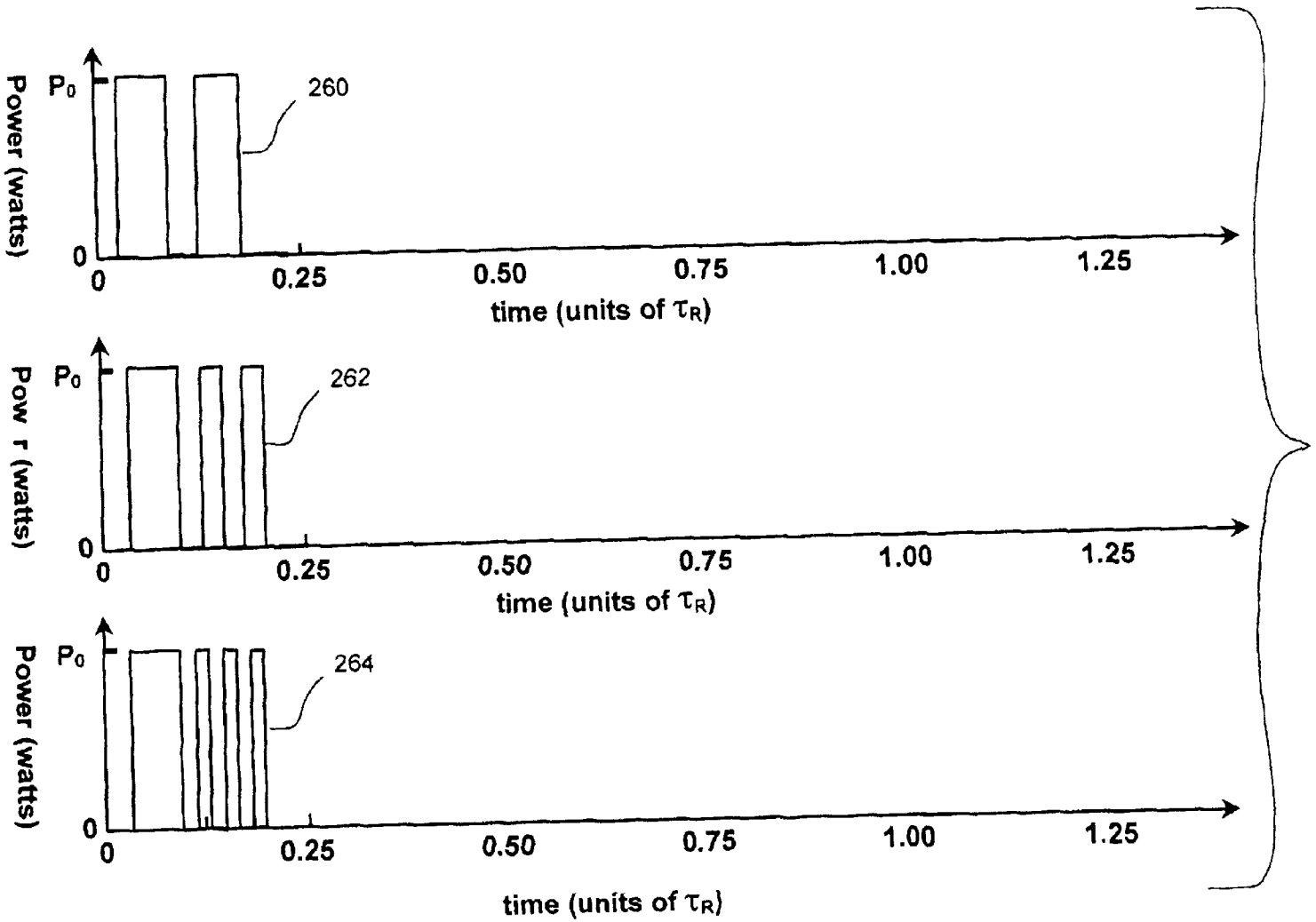
FIG. 18 is an illustrative drawing of several actuation energy pulse alternatives for operating a thermal actuator according to the present inventions.

FIG. 18 illustrates pulse sequences according to the present inventions that are designed to follow the above observations that pulses are preferably applied so that the activation has occurred before the natural resonance effects begin to reverse the motion of a moveable portion of the thermo-mechanical element. Pulse sequences for n=1, 2, and 3 are illustrated as curves 260, 262 and 264, respectively. The time axes in FIG. 18 are drawn in units of $\tau_R$, the fundamental resonant period of a thermo-mechanical actuator. This has been done to further emphasize that the heat pulse time duration's used are preferably less than ¼ $\tau_R$.

Another feature of an embodiment of the present inventions is illustrated in FIG. 18 in that all of the energy pulses are formed using a same power level $P_0$. As was noted previously, the energy pulses may be formed using different power levels and time duration's. However, for low cost implementation it may be preferable to use a single power density, for example a single power supply voltage, and then adjust energy pulse times, $t_i$, and time delays, $t_{di}$, in order to design an energy pulse sequence that activates the actuator while remaining below a maximum temperature for reliable operation.

Figure 19A:
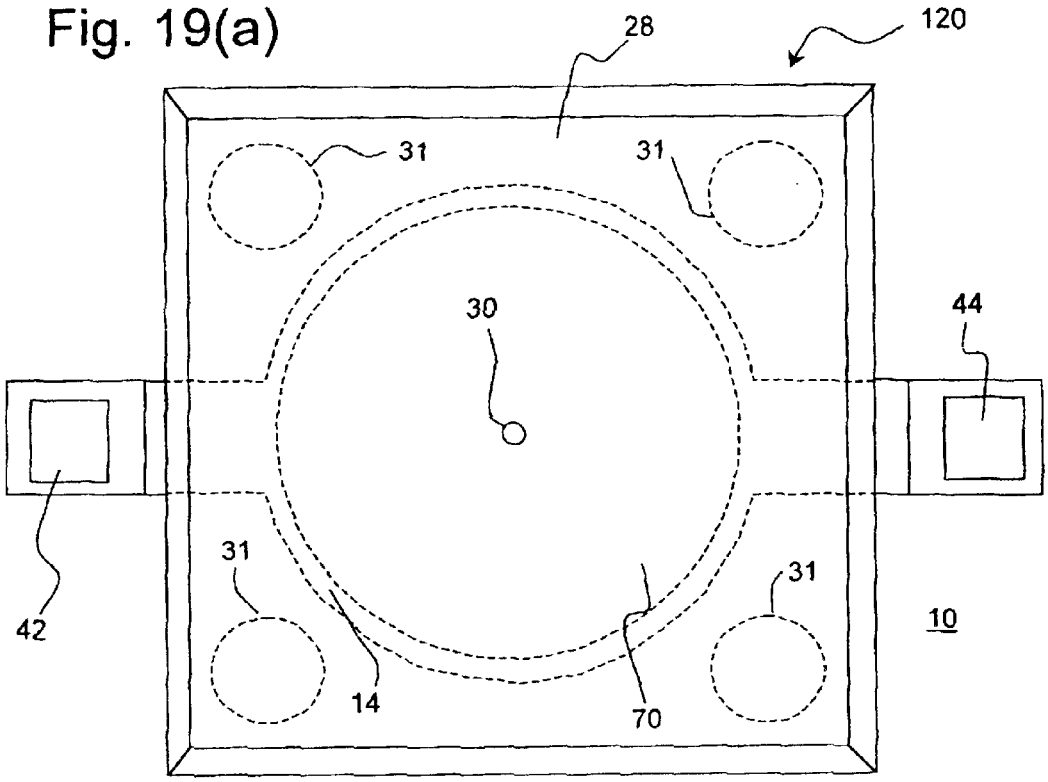
FIGS. 19(*a*) and 19(*b*) are top plan views illustrating an alternate design for a liquid drop emitter using a clamped—clamped bender element thermal actuator according to preferred embodiments of the present invention.
Figure 19B:
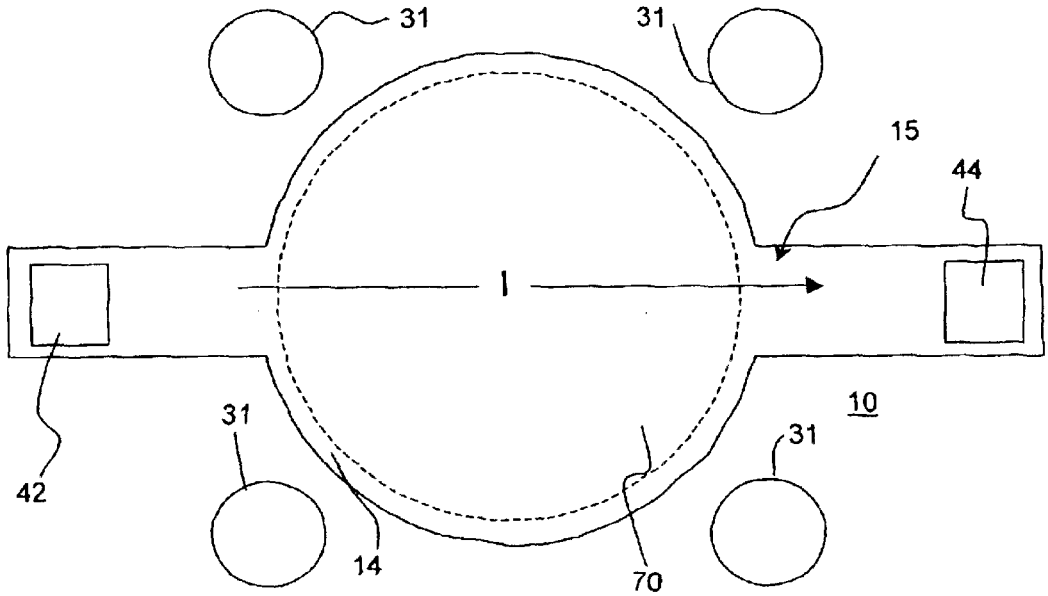

The previously discussed illusions of thermal actuators and liquid drop emitters shown deformable elements in the shape of thin cantilevered microbeams attached at one end to an anchor edge on a substrate or wall of a liquid chamber. Alternatively, a moveable element may be configured as a plate which is attached around a fully closed perimeter, or at least along two edges. Such a configuration may be termed a "clamped—clamped" element in recognition that it is restrained along at least two opposing edges. FIGS. 19(*a*) and (*b*) illustrate in plan view a clamped—clamped bender element 70 configured as a circular laminate attached fully around its circular perimeter. Such a deformable element will buckle, or pucker, in a three-dimensional fashion. A fully attached perimeter configuration of the deformable element may be advantageous when is undesirable to operate the deformable element in contact with a working fluid. Or, it may also be beneficial that the deformable element work against air, a vacuum, or other low resistance medium on one of its faces while deforming against the working fluid of the application impinging the opposite face.

FIG. 19(*a*) illustrates a liquid drop emitter unit 120 having a square fluid upper chamber 28 with a central nozzle 30. Shown in phantom in FIG. 19(*a*), a circular deformable element 70 is connected to peripheral anchor edge 14. Deformable element 70 forms a portion of a bottom wall of a fluid chamber. Fluid enters the chamber via inlet ports 31. In FIG. 19(*b*) the upper chamber 28 is removed. The heat pulses are applied by passing current via heater electrodes 42 and 44 through an electrically resistive layer included in the laminate structure of deformable element 70. The alternate configuration of thermal actuator and liquid drop emitter unit illustrated in FIGS. 19(*a*) and (*b*) may be operated according to the present inventions in a manner analogous to the operation of cantilevered element devices disc herein.

Figure 20A:
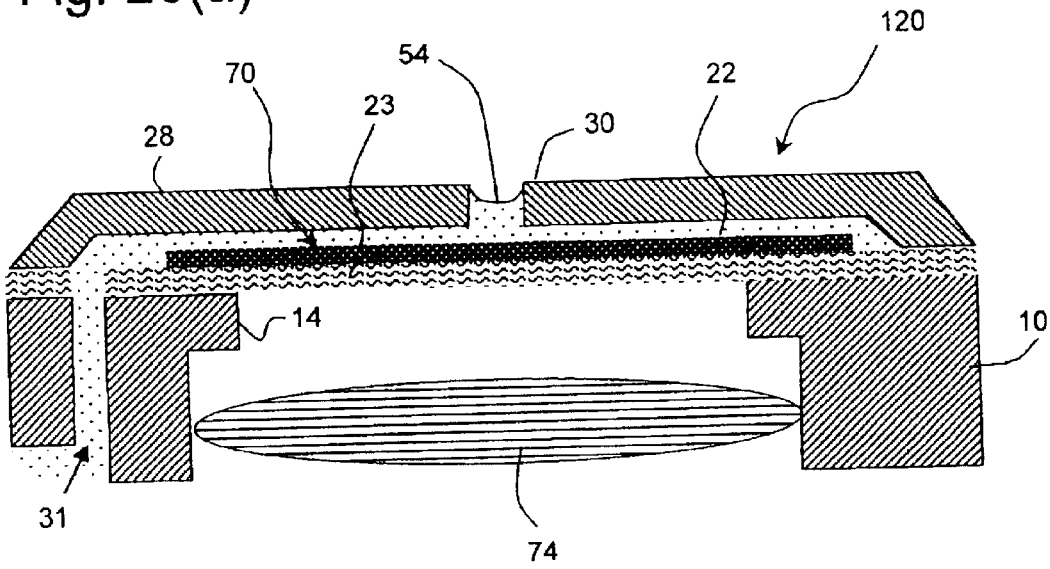
FIGS. 20(*a*) and (*b*) are side views illustrating the operation of a liquid drop emitter using a clamped—clamped bender element thermal actuator wherein the apparatus adapted to apply energy uses light energy heating pulses, according to preferred embodiments of the present invention.
Figure 20B:
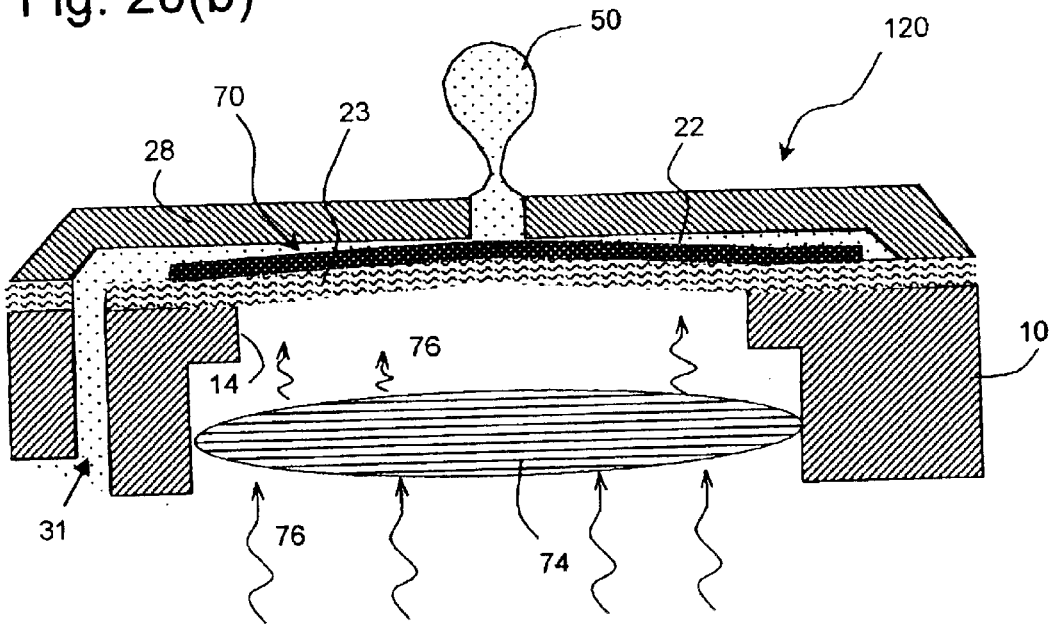

FIGS. 20(*a*) and (*b*) illustrate in side view an alternative embodiment of a drop emitter 140 which may be operated according to present inventions in which the deformable element is a circular laminate attached semi-rigidly around the full circular perimeter. The embodiment illustrated in FIGS. 20(*a*) and (*b*) is similar to that illustrated in FIGS. 19(*a*) and (*b*) except that the apparatus adapted to apply energy pulses uses light energy instead of resistive heating. The deformable element forms a portion of a "bottom" wall of a liquid drop emitter liquid chamber. The deflection layer 22 side of the deformable element has been configured to be accessible to fight energy 76 through a transparent "top" layer 23, directed by light collecting and focusing element 76. Fluid may enter the liquid chamber via inlet port 31. The drop emitter is operated by directing pulses of light energy of sufficient intensity to heat the clamped—clamped bender element 70 through the appropriate temperature time profile to cause rapid buckling.

A light-activated device according to the present inventions may be advantageous in that complete electrical isolation may be maintained while operating the drop emitter. A light-activated thermal actuator configuration for a microvalve, microswitch, light defector, and so on, may be designed in similar fashion and operated according to the present inventions.

While much of the foregoing description was directed to the configuration and operation of a single thermal actuator or drop emitter, it should be understood that the present invention is applicable to operating arrays and assemblies of multiple thermal actuators and drop emitter units. Also it should be understood that thermal actuator devices according to the present invention may be fabricated concurrently with other electronic components and circuits, or formed on the same substrate before or after the fabrication of electronic components and circuits. Electronic circuitry to carry out the methods of the present inventions may be integrated with the thermal actuator devices.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 substrate base element
11 upper liquid chamber
12 lower liquid chamber
13 gap between cantilevered element and chamber wall
14 cantilevered element anchor location
15 thermal actuator
16 liquid chamber curved wall portion
20 cantilevered element
21 passivation layer
22 deflector layer
23 top layer
24 coupling layer
25 heater resistor
26 cantilevered element anchor end portion
27 cantilevered element free end portion
28 upper liquid chamber structure, walls and cover
29 sacrificial layer
30 nozzle
31 fluid inlet path
32 fluid outlet path
41 TAB lead
42 electrical input pad
43 solder bump
44 electrical input pad
46 common electrode
50 drop
52 fluid stream
54 fluid meniscus
56 vapor or air bubbles
60 working liquid
62 first resistor segment
64 second resistor segment
66 coupling segment formed in the deflector layer
68 coupling device formed in a coupler layer
70 clamped—clamped bender element of a thermal actuator
74 light focusing lens
76 light energy
80 support structure
100 ink jet printhead
110 drop emitter unit having a cantilevered element
120 drop emitter unit having a clamped—clamped bender element.
140 drop emitter unit having a light-activated thermo-mechanical element.
200 electrical pulse source
300 controller
400 image data source
500 receiver

What is claimed is:

1. A method for operating a thermal actuator, said thermal actuator comprising a base element, a thermo-mechanical element extending from the base element, having a moveable portion residing in a first position and reliably operating at temperatures below a maximum temperature $T_{max}$, apparatus adapted to apply energy pulses to the thermo-mechanical element to cause a temperature increase therein and movement of the moveable portion to a second position, the method for operating comprising:

(a) determining a first energy pulse having a first energy, $E_1$, and a first energy pulse time, $t_1$, for suddenly increasing the temperature of the thermo-mechanical actuator, but net shove $T_{max}$;

(b) determining a second energy pulse having a second energy, $E_2$, and a second energy pulse time, $t_2$, that when applied after the first energy pulse, causes the moveable portion to move to or remain at the second position;

(c) determining a first delay time $t_{di}$, selected, at least, to avoid increasing the temperature of the thermo-mechanical element above $T_{max}$, (d) applying the first energy pulse to the thermo-mechanical element;

(e) waiting the first delay time $t_{di}$;

(f) applying the second energy pulse to the thermo-mechanical element so that the moveable portion moves to or remains at the second position and the maximum temperature is not exceeded.

2. The method of claim 1 wherein the first energy is greater than the second energy, $E_1>E_2$.

3. The method of claim 1 wherein the apparatus adapted to apply energy pulses applies energy at a same power level $P_0$ for the first and second energy pulses.

4. The method of claim 1 wherein the moveable portion is configured as a cantilevered element extending from the base element, the cantilevered element having a free end that performs an actuation function as a result of moving to the second position.

5. The method of claim 1 wherein the moveable portion is configured as a clamped—clamped bender element having a central area that performs an actuation function as a result of moving to the second position.

6. The method of claim 1 wherein the thermo-mechanical element includes a deflector layer constructed of a deflector material having a high coefficient of thermal expansion and a top layer, attached to the deflector layer, constructed of a top material having a low coefficient of thermal expansion.

7. The method of claim 6 whereat the deflector material is electrically resistive and a heater resistor is formed in the deflector layer as part of the apparatus adapted to apply energy.

8. The method of claim 7, wherein the deflector material is titanium aluminide.

9. The method of claim 1 wherein the apparatus adopted to apply energy pulses includes resistive heating of the thermo-mechanical element.

10. The method of claim 1 wherein the apparatus adapted to apply energy pulses includes absorbed light energy heating of the thermo-mechanical element.

11. The method of claim 1 wherein the thermo-mechanical element exhibits a damped mechanical resonance having a fundamental period of $\tau_R$, a total actuation time $t_A=(t_1+t_{di}+t_2)$, and $t_A<\frac{1}{4}\tau_R$.

12. A thermal actuator for performing a mechanical function comprising:

(a) a base element;

(b) a thermo-mechanical element extending from the base element, having a moveable portion residing in a first position and reliably operating a temperatures below a maximum temperature $T_{max}$;

(c) apparatus adapted to apply energy pulses to the thermo-mechanical element to cause a sudden temperature increase therein and movement of the moveable portion to a second position according to the method of claim 1 wherein the temperature of the thermo-mechanical element is not increased above the maximum temperature, $T_{max}$.

13. A method for operating a thermal actuator, said thermal actuator comprising a base element, a thermo-mechanical element extending from the base element, having a moveable portion residing in a first position and reliably operating at temperatures below a maximum temperature $T_{max}$ apparatus adapted to apply energy pulses to the thermo-mechanical element to cause a temperature increase therein and movement of the moveable portion to a second position, the method for operating comprising:

(a) determining a first energy pulse having a first energy, $E_1$, and a first energy pulse time, $t_1$, for suddenly increasing the temperature of the thermo-mechanical actuator, bit not above $T_{max}$;

(b) determining a plurality of energy pulses, n, having energies $E_{1+i}$ and energy pulse times $t_{1+i}$, and a plurality of delay times $t_{di}$ associated with each energy $E_{1+i}$, wherein i=1 to n, so that the plurality of energies, when added to the first energy, cause the moveable portion to move to or remain at the second position, and the delay times are selected, at least, to avoid increasing the temperature of the thermo-mechanical element above $T_{max}$, (c) applying a first energy pulse to the thermo-mechanical element;

(d) waiting delay time $t_{di}$;

(e) applying an energy pulse of energy $E_{1+i}$ and energy pulse time $t_{1+i}$ to the thermo-mechanical element;

(f) repeating steps (d) and (e) until the plurality of energy pulses i=1 to n have been applied to the thermo-mechanical element so that the moveable portion moves to or remains at the second position and the maximum temperature is not exceeded.

14. The method of claim 13 wherein the first energy is greater than the total of the plurality of energies, $E_{1+i}$, $E_1>(\Sigma E_{i+1}$, i=1 to n).

15. The method of claim 13 wherein the apparatus adapted to apply energy pulses applies energy at a same power level $P_0$ for the first energy pulse and for the plurality of energy pulses.

16. The method of claim 13 wherein the moveable portion is configured as a cantilevered element extending from the base element, the cantilevered element having a free end that performs an actuation function as a result of moving to the second position.

17. The method of claim 13 wherein the moveable portion is configured as a clamped—clamped bender element having a central area that performs an actuation function as a result of moving to the second position.

18. The method of claim 13 wherein the thermo-mechanical element includes a deflector layer constructed of a deflector material having a high coefficient of thermal expansion and a top layer, attached to the deflector layer, constructed of a top material having a low coefficient of thermal expansion.

19. The method of claim 18 wherein the deflector material is electrically resistive and a healer resistor in formed in the deflector layer as part of the apparatus adapted to apply energy.

20. The method of claim 19 wherein the deflector material is titanium aluminide.

21. The method of claim 13 wherein the apparatus adapted to apply energy pulses includes resistive heating of the thermo-mechanical element.

22. The method of claim 13 wherein the apparatus adapted to apply energy pulses includes absorbed light energy healing of the thermo-mechanical element.

23. The method of claim 13 wherein the thermo-mechanical element exhibits a damped mechanical resonance having a fundamental period of $\tau_R$, a total actuation time $t_A=(t_1+\Sigma(_{di}+t_{1+i})$, i=1 to n), and $t_A<\frac{1}{4}\tau_R$.

24. The method of claim 13 wherein the thermo-mechanical element exhibits a damped mechanical resonance having a fundamental period of $\tau_R$, a total actuation time $t_A=(t_1+\Sigma(t_{di}+t_{1+i})$, i=1 to n), and $t_A<\frac{1}{4}\tau_R$.

25. A thermal actuator for performing a mechanical function comprising:

(a) a base element (b) a thermo-mechanical element extending from the base element, having a moveable portion residing in a first position and reliably operating at temperatures below a maximum temperature $T_{max}$;

(c) apparatus adapted to apply energy pulses to the thermo-mechanical element to cause a sudden temperature increase therein and movement of the moveable portion to a second position according to the method of claim 13 wherein the temperature of the thermo-mechanical element is not increased above the maximum temperature, $T_{max}$.

26. A method for operating a liquid drop emitter for emitting liquid drops, said liquid drop emitter comprising a chamber, filled with a liquid, having a nozzle for emitting drops of the liquid, a thermo-mechanical actuator having a moveable portion within the chamber for applying pressure to the liquid at the nozzle and reliably operating at temperatures below a maximum temperature $T_{max}$, and apparatus adapted to apply energy pulses to the thermo-mechanical actuator, the method for operating comprising:

(a) determining a first energy pulse having a first energy, $E_1$, and a first energy pulse time, $t_1$, for suddenly increasing the temperature of the thermo-mechanical actuator, but not above $T_{max}$;

(b) determining a second energy pulse having a second energy, $E_2$, and a second energy pulse time, $t_2$, that when applied after the first energy pulse, causes the moveable portion to move to or remain at the second position;

(c) determining a first delay time, $t_{di}$, selected, at least, to avoid increasing the temperature of the thermo-mechanical element shove $T_{max}$, (d) applying the first energy pulse to the thermo-mechanical element;

(e) waking the first delay time $t_{di}$;

(f) applying the second energy pulse to the thermo-mechanical element so that the moveable portion moves to or remains at the second position causing the emission of a drop, and the maximum temperature is not exceeded.

27. The method of claim 26 wherein the liquid drop emitter is a drop-on-demand ink jet printhead and the liquid is an ink for printing image data.

28. The method of claim 26 wherein the first energy is greater than the second energy, $E_1>E_2$.

29. The method of claim 26, wherein the apparatus adapted to apply energy pulses applies energy at a same power level $P_0$ for the first and second energy pulses.

30. The method of claim 26 wherein the moveable portion is configured as a cantilevered element extending from a wall of the chamber, the cantilevered element having a free end that applies pressure to the liquid at the nozzle as a result of moving to the second position.

31. The method of claim 26 wherein the moveable portion is configured as a clamped—clamped bender element within the chamber and having a central area that applies pressure to the liquid at the nozzle as result of moving to the second position.

32. The method of claim 26, wherein the thermo-mechanical element includes a deflector layer constructed of a deflector material having a high coefficient of thermal expansion and atop layer, attached to the deflector layer, constructed of a top material having a low coefficient of thermal expansion.

33. The method of claim 32 where in the deflector material is electrically resistive and a heater resistor is formed in the deflector layer as part of the apparatus adapted to apply energy.

34. The method of claim 33 wherein the deflector material is titanium aluminide.

35. The method of claim 26 wherein the apparatus adapted to apply energy pulses includes resistive heating of the thermo-mechanical element.

36. The method of claim 26 wherein the apparatus adapted to apply energy pulses includes absorbed light energy heating of the thermo-mechanical element.

37. The method of claim 26 wherein the thermo-mechanical element exhibits a damped mechanical resonance having a fundamental period of $\tau_R$, a total actuation time $t_A(t_1+t_{di}+t_2)$, and $t_A<\frac{1}{4}\tau_R$.

38. A liquid drop emitter for emitting liquid drops, said liquid drop emitter comprising:

(a) a chamber, filled with a liquid, having a nozzle for emitting drops of the liquid, (b) a thermo-mechanical actuator having a moveable portion within the chamber for applying pressure to the liquid at the nozzle and reliably operating a temperatures below a maximum temperature $T_{max}$, and (c) apparatus adapted to apply energy pulses to the thermo-mechanical actuator to cause a sudden temperature increase therein and movement of the moveable portion to a second position according to the method of claim 26 causing the emission of a drop, and the maximum temperature is not exceeded.

39. A method for operating a liquid drop emitter for emitting liquid drops, said liquid drop emitter comprising a chamber, filled with a liquid, having a nozzle for emitting drops of the liquid, a thermo-mechanical actuator having a moveable portion within the chamber for applying pressure to the liquid at the nozzle and reliably operating at temperatures below a maximum temperature $T_{max}$, and apparatus adapted to apply energy pulses to the thermo-mechanical actuator, the method for operating comprising:

(a) determining a first energy pulse having a first energy, $E_1$, and a first energy pulse time, $t_1$, for suddenly increasing the temperature of the thermo-mechanical actuator, but not above $T_{max}$;

(b) determining a plurality of energy pulses, n, having energies $E_{1+i}$ and energy pulse times $t_{1+i}$, and a plurality of delay times $t_{di}$ associated with each energy $E_{1+i}$, wherein i=1 to n, so that the plurality of energies, when added to the first energy, cause the moveable portion to move to or remain at the second position, and the delay times are selected, at least to avoid increasing the temperature of the thermo-mechanical element above $T_{max}$;

(c) applying a first energy pulse to the thermo-mechanical element;

(d) waiting delay time $t_{di}$;

(e) applying an energy pulse of energy $E_{1+i}$ and energy pulse time $t_{1',i}$ to the thermo-mechanical element;

(f) repeating steps (d) and (e) until the plurality of energy pulses i+1 to n have been applied to the thermo-mechanical element so that the moveable portion moves to or remains at the second position causing the emission of a drop, and the maximum temperature as not exceeded.

40. The method of claim 39, wherein the liquid drop emitter is a drop-on-demand ink jet printer and the liquid is an ink for printing image data.

41. The method of claim 39, wherein the first energy is greater than the total of the plurality of energies, $E_{1+i}$, $E_1>(\Sigma E_{i+1}$, i=1 to n).

42. The method of claim 39, wherein the apparatus adapted to apply energy pulses applies energy at a same power level $P_0$ for the first energy pulse and for the plurality of energy pulses.

43. The method of claim 39 wherein the moveable portion is configured as a cantilevered element extending from a wall of the chamber, the cantilevered element having a free end that applies pressure to the liquid at the nozzle as a result of moving to the second position.

44. The method of claim 39 wherein the moveable portion is configured as a clamped—clamped bender element within the chamber and having a central area that applies pressure to the liquid at the nozzle as a result of moving to the second position.

45. The method of claim 39 wherein the thermo-mechanical element includes a deflector layer constructed of a deflector material having a high coefficient of thermal expansion and a top layer, attached to the deflector layer, constructed of a top material having a low coefficient of thermal expansion.

46. The method of claim 45 wherein the deflector material is electrically resistive and a healer resistor is formed in the deflector layer as part of the apparatus adapted to apply energy.

47. The method of claim 46 wherein the deflector material is titanium aluminide.

48. The method of claim 39, wherein the apparatus adapted to apply energy pulses includes resistive heating of the thermo mechanical element.

49. The method of claim 39 wherein the apparatus adapted to apply energy pulses includes absorbed energy heating of the thermo-mechanical element.

50. A liquid drop emitter for emitting liquid drops, said liquid drop emitter comprising:

(a) a chamber, filled with a liquid, having a nozzle for emitting drops of the liquid, (b) a thermo-mechanical actuator having a moveable portion within the chamber for applying pressure to the liquid at the nozzle and reliably operating at temperatures below a maximum temperature $T_{max}$, and (c) apparatus adapted to apply energy pulses to the thermo-mechanical actuator to cause a sudden temperature increase therein and movement of the movable portion to a second position according to the method of claim 26 causing the emission of a drop, and the maximum temperature is not exceeded.

* * * * *

UNITED STATES PATENT AND TRADEMARK OFFICE

CERTIFICATE OF CORRECTION

PATENT NO. : 6,848,771 B2
DATED : February 1, 2005
INVENTOR(S) : Antonio Cabal

It is certified that error appears in the above-identified patent and that said Letters Patent is hereby corrected as shown below:

Title page,
Item [74], *Attorney, Agent, or Firm,* delete "Antonio Cabal" and insert -- William R. Zimmerli --.

Column 16,
Line 47, after "but" delete "net shove" and insert -- not above --.
Line 53, after "delay time" delete "$t_A = (t_1 + t_{di} + t_2)$" and insert -- $t_A = (t_1 + t_{d1} + t_2)$, --.
Line 58, after "delay time" delete "$t_{di}$" and insert -- $t_{d1}$ --.

Column 17,
Line 15, delete "whereat" and insert -- wherein --.
Line 21, delete "adopted" and insert -- adapted --.
Line 30, delete "$t_A = (t_1 + t_{di} + t_2)$," and insert -- $t_A = (t_1 + t_{d1} + t_2)$, --.

Column 18,
Line 7, after "and" delete "(c)" and insert -- (e) --.
Line 49, delete "$t_A = (t_1 + \Sigma( {}_{di} + t_{1+i})$," and insert -- $t_A = (t_1 + \Sigma( t_{di} + t_{1+i})$, --.

Column 19,
Lines 19 and 24, delete "$t_{di}$" insert -- $t_{d1}$ --.

Column 20,
Line 2, delete "$t_A = (t_1 + t_{di} + t_2)$" and insert -- $t_A = (t_1 + t_{d1} + t_2)$ --.
Line 44, after "pulse time" delete "$t_{1.i}$" and insert -- $t_{1+i}$ --.
Line 46, after "pulses" delete "i+1" and insert -- i=1 --.

UNITED STATES PATENT AND TRADEMARK OFFICE

CERTIFICATE OF CORRECTION

PATENT NO. : 6,848,771 B2
DATED : February 1, 2005
INVENTOR(S) : Antonio Cabal

It is certified that error appears in the above-identified patent and that said Letters Patent is hereby corrected as shown below:

Column 21,
Line 11, delete “healer” and insert -- heater --.

Signed and Sealed this

Sixth Day of December, 2005

JON W. DUDAS
*Director of the United States Patent and Trademark Office*